US009718168B2

(12) United States Patent
Mukhopadhyay et al.

(10) Patent No.: US 9,718,168 B2
(45) Date of Patent: Aug. 1, 2017

(54) METHODS OF FABRICATING POLYCRYSTALLINE DIAMOND COMPACTS AND RELATED CANISTER ASSEMBLIES

(71) Applicant: US SYNTHETIC CORPORATION, Orem, UT (US)

(72) Inventors: Debkumar Mukhopadhyay, Sandy, UT (US); Robert J. Farr, Orem, UT (US); Ronald W. Ward, Pleasant Grove, UT (US); Edwin Sean Cox, Spanish Fork, UT (US); Damon Bart Crockett, Mapleton, UT (US); Daniel Preston Wilding, Springville, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 100 days.

(21) Appl. No.: 14/677,821

(22) Filed: Apr. 2, 2015

(65) Prior Publication Data

US 2015/0209937 A1 Jul. 30, 2015

Related U.S. Application Data

(63) Continuation-in-part of application No. 14/086,283, filed on Nov. 21, 2013, and a continuation-in-part of application No. 14/304,631, filed on Jun. 13, 2014.

(51) Int. Cl.
*E21B 10/46* (2006.01)
*B22F 7/00* (2006.01)
(Continued)

(52) U.S. Cl.
CPC ..... *B24D 3/10* (2013.01); *B22F 3/1208* (2013.01); *B22F 3/14* (2013.01); *B22F 7/06* (2013.01);
(Continued)

(58) Field of Classification Search
CPC .... B22F 7/00; B01J 3/06; E21B 10/46; B24D 18/00
See application file for complete search history.

(56) References Cited

U.S. PATENT DOCUMENTS 3,935,034 A 1/1976 Hayes
4,268,276 A 5/1981 Bovenkerk
(Continued)

FOREIGN PATENT DOCUMENTS

EP 1079063 2/2001
EP 1149937 10/2001
(Continued)

OTHER PUBLICATIONS

International Search Report and Written Opinion from International Application No. PCT/US2014/058121 dated Mar. 31, 2015.
(Continued)

*Primary Examiner* — Pegah Parvini
(74) *Attorney, Agent, or Firm* — Dorsey & Whitney LLP

(57) ABSTRACT

Embodiments disclosed herein involve polycrystalline diamond ("PCD") tables and polycrystalline diamond compacts ("PDCs") that include PCD tables as well as methods and apparatuses for manufacturing thereof. Some embodiments include a canister assembly that may be used in a high-pressure/high-temperature ("HPHT") process or other heating process to manufacture the PCD tables and/or the PDCs.

23 Claims, 10 Drawing Sheets

(51) Int. Cl.

| | |
|---|---|
| ***B24D 3/10*** | (2006.01) |
| ***B24D 18/00*** | (2006.01) |
| ***C22C 26/00*** | (2006.01) |
| ***E21B 10/55*** | (2006.01) |
| ***E21B 10/567*** | (2006.01) |
| ***E21B 10/573*** | (2006.01) |
| ***B22F 3/12*** | (2006.01) |
| ***B22F 3/14*** | (2006.01) |
| ***B22F 7/06*** | (2006.01) |

(52) U.S. Cl.
CPC ..... *B24D 18/0009* (2013.01); *C22C 26/00* (2013.01); *E21B 10/55* (2013.01); *E21B 10/567* (2013.01); *E21B 10/5735* (2013.01)

(56) References Cited

U.S. PATENT DOCUMENTS

| | | | | |
|---|---|---|---|---|
| 4,274,900 | A | 6/1981 | Mueller et al. | |
| 4,410,054 | A | 10/1983 | Nagel et al. | |
| 4,468,138 | A | 8/1984 | Nagel | |
| 4,560,014 | A | 12/1985 | Geczy | |
| 4,738,322 | A | 4/1988 | Hall et al. | |
| 4,811,801 | A | 3/1989 | Salesky et al. | |
| 4,907,377 | A | 3/1990 | Csillag et al. | |
| 4,913,247 | A | 4/1990 | Jones | |
| 5,016,718 | A | 5/1991 | Tandberg | |
| RE33,767 | E | 12/1991 | Christini et al. | |
| 5,092,687 | A | 3/1992 | Hall | |
| 5,120,327 | A | 6/1992 | Dennis | |
| 5,127,923 | A | 7/1992 | Bunting et al. | |
| 5,135,061 | A | 8/1992 | Newton, Jr. | |
| 5,154,245 | A | 10/1992 | Waldenstrom et al. | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 5,759,216 | A | 6/1998 | Kanada et al. | |
| 6,261,329 | B1 | 7/2001 | Ogata et al. | |
| 6,338,754 | B1 | 1/2002 | Cannon et al. | |
| 6,541,115 | B2 | 4/2003 | Pender et al. | |
| 6,793,681 | B1 | 9/2004 | Pope et al. | |
| 7,353,893 | B1 | 4/2008 | Hall et al. | |
| 7,473,287 | B2 | 1/2009 | Belnap et al. | |
| 7,635,035 | B1 | 12/2009 | Bertagnolli et al. | |
| 7,647,993 | B2 | 1/2010 | Middlemiss | |
| 7,726,421 | B2 | 6/2010 | Middlemiss | |
| 7,866,418 | B2 | 1/2011 | Bertagnolli et al. | |
| 7,950,477 | B1 | 5/2011 | Bertagnolli et al. | |
| 7,998,573 | B2 | 8/2011 | Qian et al. | |
| 8,034,136 | B2 | 10/2011 | Sani | |
| 8,069,935 | B1 | 12/2011 | Miess et al. | |
| 8,080,071 | B1 | 12/2011 | Vail | |
| 8,109,349 | B2 | 2/2012 | Hall et al. | |
| 8,236,074 | B1 | 8/2012 | Bertagnolli et al. | |
| 8,277,722 | B2 | 10/2012 | DiGiovanni | |
| 2008/0219914 | A1 | 9/2008 | Smallman et al. | |
| 2011/0030283 | A1* | 2/2011 | Cariveau | B22F 7/062 51/297 |
| 2012/0012402 | A1 | 1/2012 | Thigpen et al. | |
| 2012/0152622 | A1 | 6/2012 | Sue et al. | |
| 2012/0241226 | A1 | 9/2012 | Bertagnolli et al. | |
| 2012/0261197 | A1 | 10/2012 | Miess et al. | |
| 2012/0324801 | A1 | 12/2012 | Fang | |
| 2012/0325565 | A1 | 12/2012 | Fang | |
| 2013/0067826 | A1* | 3/2013 | Vaughn | B01J 3/062 51/307 |
| 2013/0068540 | A1* | 3/2013 | DiGiovanni | B24D 18/0009 175/434 |
| 2013/0068541 | A1 | 3/2013 | DiGiovanni | |
| 2013/0092451 | A1 | 4/2013 | Mukhopadhyay et al. | |
| 2013/0092452 | A1 | 4/2013 | Mukhopadhyay et al. | |
| 2013/0180181 | A1 | 7/2013 | Nixon et al. | |
| 2014/0047776 | A1 | 2/2014 | Scott et al. | |
| 2014/0283457 | A1 | 9/2014 | Cariveau et al. | |
| 2015/0209745 | A1 | 7/2015 | Mukhopadhyay et al. | |
| 2015/0211306 | A1 | 7/2015 | Mukhopadhyay et al. | |

FOREIGN PATENT DOCUMENTS

| | | |
|---|---|---|
| GB | 376467 | 7/1932 |
| GB | 1496106 | 12/1977 |
| JP | 9254042 | 9/1997 |
| WO | WO 2008/062369 | 5/2008 |
| WO | WO 2008/074010 | 6/2008 |
| WO | WO 2012/139060 | 10/2012 |
| WO | WO 2012/173893 | 12/2012 |
| WO | WO 2013/092370 | 6/2013 |

OTHER PUBLICATIONS

Ishida et al. "The Co-P (Cobalt-Phosphorus) System" Bulletin of Alloy Phase Diagrams, ASM International, vol. 11, No. 6, Dec. 1, 1990, pp. 555-559.
Partial International Search Report from International Application No. PCT/US2015/034900 mailed Sep. 29, 2015.
U.S. Appl. No. 12/555,715, filed Sep. 8, 2009, Miess et al.
U.S. Appl. No. 13/275,372, filed Oct. 18, 2011, Mukhopadhyay et al.
U.S. Appl. No. 13/751,405, filed Jan. 28, 2013, Gleason.
U.S. Appl. No. 14/086,283, filed Nov. 21, 2013, Knuteson et al.
U.S. Appl. No. 14/304,631, filed Jun. 13, 2014, Mukhopadhyay et al.
Ahmed, et al., "Chemical Vapor Deposition of Diamond Coatings onto Dental Burrs", Journal of Chemical Education, vol. 80, No. 6, Jun. 2003, pp. 636-641.
Cremer, et al. "Formation of intermetallic cobalt phases in the near surface region of cemented carbides for improved diamond layer deposition," Thin Solid Films 355-356 (2999) pp. 127-133.
Decker et al. "High-Pressure Calibration: A Critical Review," J. Phys. Chem. Ref. Data, 1, 3 (1972).
Guobiao, et al., "Boronizing mechanism of cemented carbides and their wear resistance," Int. Journal of Refractory Metals and Hard Materials, 41 (2013) pp. 351-355.
Rousse, et al. "Structure of the Intermediate Phase of PbTe at High Pressure," Physical Review B: Condensed Matter and Materials Physics, 71, 224116 (2005).
International Search Report and Written Opinion from International Application No. PCT/US2015034900 mailed Dec. 10, 2015.
Non-Final Office Action for U.S. Appl. No. 14/086,283 mailed Aug. 24, 2016.
Non-Final Office Action for U.S. Appl. No. 14/677,821 mailed Sep. 23, 2016.
Notice of Allowance for U.S. Appl. No. 14/677,859 mailed Aug. 3, 2016.
Notice of Allowance received for U.S. Appl. No. 14/677,859 mailed Nov. 21, 2016.
Restriction Requirement for U.S. Appl. No. 14/086,283 mailed Apr. 15, 2016.
Restriction Requirement received for U.S. Appl. No. 14/304,631 mailed Nov. 17, 2016.
U.S. Appl. No. 14/677,859, filed Apr. 2, 2015.
U.S. Appl. No. 14/677,875, filed Apr. 2, 2015.
Final Office Action for U.S. Appl. No. 14/086,283 mailed Feb. 3, 2017.
Non-Final Office Action for U.S. Appl. No. 14/304,631 mailed Mar. 23, 2017.

* cited by examiner

METHODS OF FABRICATING POLYCRYSTALLINE DIAMOND COMPACTS AND RELATED CANISTER ASSEMBLIES

CROSS-REFERENCE TO RELATED APPLICATIONS

This application is a continuation-in-part of U.S. application Ser. No. 14/086,283 filed on 21 Nov. 2013 and a continuation-in-part of U.S. application Ser. No. 14/304,631 filed on 13 Jun. 2014. The disclosure of each of the foregoing applications is incorporated, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in formation of a matrix of bonded diamond grains having diamond-to-diamond bonding therebetween. At least some interstitial regions between the bonded diamond grains are occupied by the metal-solvent catalyst.

Despite the availability of a number of different PDCs, manufacturers and users of PDCs continue to seek improved techniques for manufacturing PDCs.

SUMMARY

Embodiments disclosed herein are directed to PCD tables and PDCs that include PCD tables as well as methods and apparatuses for manufacturing thereof. Some embodiments include a canister assembly that may be used in an HPHT process or other heating process to manufacture PCD tables and/or PDCs, as described below in more detail. For example, the canister assembly may include a canister that may enclose a compact assembly for processing (e.g., in an HPHT press). For example, the canister may secure a substrate, a diamond volume (e.g., diamond powder and/or a sintered PCD table), and one or more alloying materials that may be positioned near the PCD table or diamond powder.

At least one embodiment is directed to a method of manufacturing a PDC. The method includes forming a canister assembly that includes a first canister portion and a second canister portion. The first canister portion and the second canister portion collectively define an internal volume of the canister assembly. The canister assembly also includes a compact assembly positioned in the internal volume of the canister assembly. The compact assembly includes diamond (e.g., diamond powder or a PCD element) and one or more alloying materials positioned adjacent to the diamond. The method also includes sealing the internal volume of the canister to form a sealed internal volume including the compact assembly therein. After sealing the canister assembly, the method includes subjecting the canister assembly, including the compact assembly therein, to one or more of an HPHT process or a heating process effective to alloy the PCD element with the phosphorous.

Embodiments are also directed to a canister assembly for fabricating a PDC. The canister assembly includes a canister defining a sealed internal volume, and a compact assembly positioned inside the sealed internal volume of the canister. The compact assembly includes a substrate, diamond (e.g., diamond powder or a PCD table) positioned adjacent to the substrate (e.g., bonded or not bonded to the substrate), and one or more alloying materials positioned adjacent to the diamond. The canister may be configured to limit the one or more alloying materials from interacting with the substrate.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1:
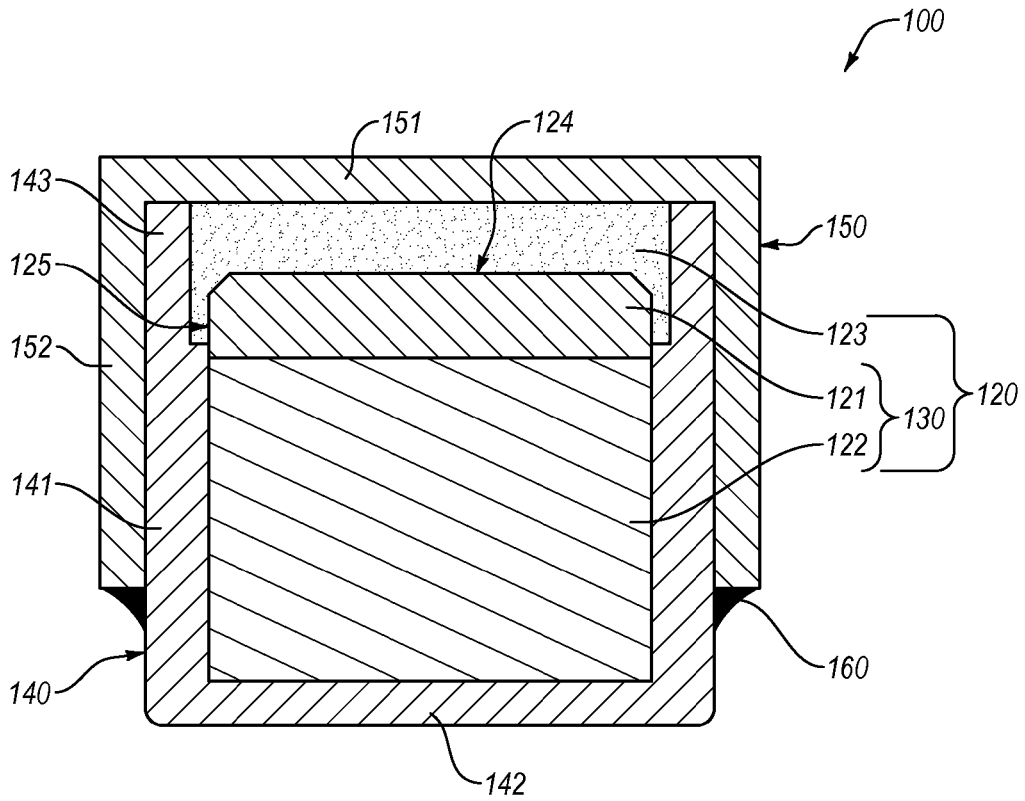
FIG. 1 is cross-sectional view of a canister and a compact assembly positioned in an internal volume of the canister according to an embodiment.

Embodiments disclosed herein involve PCD tables and PDCs that include PCD tables as well as methods and apparatuses for manufacturing thereof. Some embodiments include a canister assembly that may be used in an HPHT process or other heating process to manufacture PCD tables and/or PDCs, as described below in more detail. For example, the canister assembly may include a canister that may surround a compact assembly for processing (e.g., in an HPHT press). For example, the canister may hold a substrate, diamond (e.g., diamond powder and/or a PCD table), and one or more infiltrants or alloying materials that may be positioned near the PCD table or diamond.

In one or more embodiments, the canister may include multiple portions that may be assembled and/or connected together to house or enclose the compact assembly. In particular, after assembly, at least some of the multiple portions of the canister may collectively define an internal volume within which the compact assembly may be secured and/or sealed. In any event, the canister may be configured in a manner that facilitates positioning the compact assembly in the internal volume of the canister for processing (e.g., heating, subjecting the compact assembly and canister to an HPHT process or other heating process, etc.).

During heating and/or HPHT processing of the compact assembly, air may oxidize one or more of the elements and/or components thereof, such as diamond grains of a PCD table and/or diamond particles defining diamond powder. In some embodiments, after the compact assembly is placed into the internal volume of the canister, the canister may be closed or sealed in an inert or substantially inert environment. For example, air may be first evacuated or otherwise removed from the internal volume of the canister to produce a partial vacuum therein; subsequently or concurrently, canister portions that define the internal volume may be closed or sealed to maintain the partial vacuum therein. Additionally or alternatively, an inert gas may be introduced into the internal volume before sealing thereof, which displaces air that previously occupied the internal volume. Moreover, the canister may be sealed in a manner that prevent or impedes air from entering the canister after the sealing.

Generally, the compact assembly may vary from one embodiment to the next. As noted above, in some embodiments, the compact assembly includes diamond powder positioned near and/or adjacent to the substrate. In other embodiments, the compact assembly may include a sintered, preformed PCD table or disc positioned adjacent to and/or bonded to a substrate. For example, the PCD table may include a plurality of directly bonded together diamond grains exhibiting diamond-to-diamond bonding therebetween (e.g., $sp^3$ bonding) defining a plurality of interstitial regions, with at least a portion of the plurality of interstitial regions including at least one Group VIII metal disposed therein. For example, the at least one Group VIII metal may comprise cobalt, iron, nickel, alloys thereof, or combinations of the foregoing metals and alloys. Moreover, the compact assembly may include one or more additives or alloying materials that may be positioned near and/or adjacent to the PCD table (e.g., the alloying material(s) may infiltrate the PCD table during processing of the compact assembly), near the diamond powder, mixed with diamond powder, or combinations of the foregoing. In some embodiments, the alloying material(s) may be positioned adjacent to and/or mixed with the diamond powder.

In one or more embodiments, the alloying material(s) may include phosphorous, which may be positioned adjacent to a sintered, preformed PCD table or disk. Phosphorous may infiltrate the preformed PCD table during processing of the compact assembly to alloy with one or more constituents of the PCD table, such as the at least one Group VIII metal interstitially disposed therein. In some embodiments, the compact assembly includes diamond powder, and phosphorous may be mixed with the diamond powder before processing thereof. As noted above, the canister containing the compact assembly may be sealed after removal of at least some of the oxidants and/or contaminants therefrom. Under some conditions, phosphorous may be flammable and/or explosive (e.g., when temperature of phosphorous is raised above a degradation temperature). In at least one embodiment, sealing of the canister may be such that phosphorous is maintained at or below a degradation temperature thereof, such as a temperature above which the phosphorous burns.

According to various embodiments, an alloy in the interstitial regions of the PCD table may be formed from alloying the at least one Group VIII metal with the alloying material(s) during processing of the compact assembly contained in the container. The alloy so formed includes at least one Group VIII metal including cobalt, iron, nickel, or alloys thereof and at least one alloying material selected from silver, gold, aluminum, antimony, boron, carbon, cerium, chromium, copper, dysprosium, erbium, iron, gallium, germanium, gadolinium, hafnium, holmium, indium, lanthanum, magnesium, manganese, molybdenum, niobium, neodymium, nickel, phosphorous, praseodymium, platinum, ruthenium, sulfur, antimony, scandium, selenium, silicon, samarium, tin, tantalum, terbium, tellurium, thorium, titanium, vanadium, tungsten, yttrium, zinc, zirconium, and any combination thereof. For example, a more specific group for the alloying material includes boron, copper, gallium, germanium, gadolinium, phosphorous, silicon, tin, zinc, zirconium, and combinations thereof. The alloying material(s) may be present with the at least one Group VIII metal in the alloy in an amount at a eutectic composition, hypo-eutectic composition, or hyper-eutectic composition for the at least one Group VIII-alloying material(s) chemical system if the at least one Group VIII-alloying material(s) has a eutectic composition. The alloying material(s) may lower a melting temperature of the at least one Group VIII metal, a bulk modulus of the at least one Group VIII metal, a coefficient of thermal expansion of the at least one Group VIII metal, or combinations thereof.

Table I below lists various different embodiments for the at least one alloying material of the alloy. For some of the at least one alloying materials, the eutectic composition with cobalt and the corresponding eutectic temperature at 1 atmosphere is also listed. As previously noted, in such alloys, in some embodiments, the at least one alloying material may be present at a eutectic composition, hypo-eutectic composition, or hyper-eutectic composition for the cobalt-alloying element chemical system.

TABLE I

| Alloying Material | Melting Point (° C.) | Eutectic Composition (Atomic %) | Eutectic Temperature (° C.) |
|---|---|---|---|
| Silver (Ag) | 960.8 | N/A | N/A |
| Aluminum (Al) | 660 | N/A | N/A |
| Gold (Au) | 1063 | N/A | N/A |
| Boron (B) | 2030 | 18.5 | 1100 |
| Bismuth (Bi) | 271.3 | N/A | N/A |
| Carbon (C) | 3727 | 11.6 | 1320 |
| Cerium (Ce) | 795 | 76 | 424 |
| Chromium (Cr) | 1875 | 44 | 1395 |
| Copper (Cu) | 1085 | N/A | N/A |
| Dysprosium (Dy) | 1409 | 60 | 745 |
| Erbium (Er) | 1497 | 60 | 795 |
| Iron (Fe) | 1536 | N/A | N/A |
| Gallium (Ga) | 29.8 | 80 | 855 |
| Germanium (Ge) | 937.4 | 75 | 817 |
| Gadolinium (Gd) | 1312 | 63 | 645 |
| Hafnium (Hf) | 2222 | 76 | 1212 |
| Holmium (Ho) | 1461 | 67 | 770 |
| Indium (In) | 156.2 | 23 | 1286 |
| Lanthanum (La) | 920 | 69 | 500 |
| Magnesium (Mg) | 650 | 98 | 635 |
| Manganese (Mn) | 1245 | 36 | 1160 |
| Molybdenum (Mo) | 2610 | 26 | 1335 |
| Niobium (Nb) | 2468 | 86.1 | 1237 |
| Neodymium (Nd) | 1024 | 64 | 566 |
| Nickel (Ni) | 1453 | N/A | N/A |
| Phosphorus (P) | 44.1 (white), 610 (black), 621 (red) | 19.9 | 1023 |
| Praseodymium (Pr) | 935 | 66 | 560 |
| Platinum (Pt) | 1769 | N/A | N/A |
| Ruthenium (Ru) | 2500 | N/A | N/A |
| Sulfur (S) | 119 | 41 | 822 |
| Antimony (Sb) | 630.5 | 97 | 621 |
| Scandium (Sc) | 1539 | 71.5 | 770 |
| Selenium (Se) | 217 | 44.5 | 910 |
| Silicon (Si) | 1410 | 23 | 1195 |
| Samarium (Sm) | 1072 | 64 | 575 |
| Tin (Sn) | 231.9 | N/A | N/A |
| Tantalum (Ta) | 2996 | 13.5 | 1276 |
| Terbium (Tb) | 1356 | 62.5 | 690 |
| Tellurium (Te) | 449.5 | 48 | 980 |
| Thorium (Th) | 1750 | 38 | 960 |
| Titanium (Ti) | 1668 | 76.8 | 1020 |

TABLE I-continued

| Alloying Material | Melting Point (° C.) | Eutectic Composition (Atomic %) | Eutectic Temperature (° C.) |
|---|---|---|---|
| Vanadium (V) | 1900 | N/A | N/A |
| Tungsten (W) | 3410 | N/A | N/A |
| Yttrium (Y) | 1409 | 63 | 738 |
| Zinc (Zn) | 419.5 | N/A | N/A |
| Zirconium (Zr) | 1852 | 78.5 | 980 |

Moreover, according to additional or alternative embodiments, the alloy includes at least one Group VIII metal including cobalt, iron, nickel, or alloys thereof; phosphorous; and optionally other constituents. The phosphorous and/or other alloying material(s) may be present with the at least one Group VIII metal in the alloy in an amount of about greater than 0 to about 40 atomic %, about 5 atomic % to about 35 atomic %, about 15 atomic % to about 35 atomic %, about 20 atomic % to about 35 atomic %, about 5 atomic % to about 15 atomic %, or about 30 weight % to about 35 weight % of the alloy. In some embodiments, the phosphorous and/or other alloying material(s) may be present with the at least one Group VIII metal in an amount at a eutectic composition, hypo-eutectic composition, or hyper-eutectic composition for the at least one Group VIII-phosphorous chemical system if the at least one Group VIII-phosphorous has a eutectic composition. The phosphorous and/or other alloying material(s) may lower a melting temperature of the at least one Group VIII metal, a bulk modulus of the at least one Group VIII metal, a coefficient of thermal expansion of the at least one Group VIII metal, or any combination thereof.

Depending on the alloy system, in some embodiments, the alloy disposed interstitially in the PCD table includes: one or more solid solution alloy phases of the at least one Group VIII metal and the alloying material(s); one or more intermediate compound phases (e.g., one or more intermetallic compounds) between the alloying material(s) and the at least one Group VIII metal and/or other metal (e.g., tungsten); to form one or more binary or higher-order intermediate compound phases; one or more carbide phases between the alloying material(s), carbon, and optionally other metal(s); the alloying material(s) in elemental form, carbon, and optionally other metals; or combinations thereof. In some embodiments, one or more alloying materials may be present in an amount less than about 40 weight % of the alloy, such as less than about 30 weight % less, less than about 20 weight %, less than about 15 weight %, less than about 10 weight %, about 5 weight % to about 35 weight %, about 10 weight % to about 30 weight %, about 15 weight % to about 25 weight %, about 5 weight % to about 10 weight %, about 1 weight % to about 4 weight %, or about 1 weight % to about 3 weight %, with the balance being the one or more solid solution phases and/or one or more carbide phases. In other embodiments, when the one or more intermediate compounds are present in the alloy, the one or more intermediate compounds be present in the alloy in an amount greater than about 80 weight % of the alloy, such as greater than about 90 weight %, about 90 weight % to about 100 weight %, about 90 weight % to about 95 weight %, about 90 weight % to about 97 weight %, about 92 weight % to about 95 weight %, about 97 weight % to about 99 weight %, or about 100 weight % (i.e., substantially all of the alloy). That is, in some embodiments, the alloy may be a multi-phase alloy that may include one or more solid solution alloy phases, one or more intermediate compound phases, one or more carbide phases, one or more elemental constituent (e.g., an elemental alloying material, elemental carbon, or an elemental group VIII metal) phases, or combinations thereof. The inventors currently believe that the presence of the one or more intermediate compounds may enhance the thermal stability of the PCD table due to the relatively lower coefficient of thermal expansion of the one or more intermediate compounds compared to a pure Group VIII metal, such as cobalt. Additionally, in some embodiments, the inventors currently believe that the presence of the solid solution alloy of the at least one Group VIII metal may enhance the thermal stability of the PCD table due to lowering of the melting temperature and/or bulk modulus of the at least one Group VIII metal. In some embodiments, the presence of the solid solution alloy of the at least one Group VIII metal and alloying material(s) may decrease or eliminate the tendency of the at least one Group VIII metal therein to cause back-conversion of carbon atoms of the diamond grains in the PCD table to graphite at high temperatures, such as those experienced under drilling conditions by a PDC cutter.

For example, when the at least one Group VIII element is cobalt and the alloying material(s) is boron, the alloy may include WC phase, $Co_AW_BB_C$ (e.g., $Co_{21}W_2B_6$) phase, $Co_DB_E$ (e.g., $Co_2B$ or $BCo_2$) phase, and Co phase (e.g., substantially pure cobalt or a cobalt solid solution phase) in various amounts. According to one or more embodiments, the WC phase may be present in the alloy in an amount less than 1 weight %, or less than 3 weight %; the $Co_AW_BB_C$ (e.g., $Co_{21}W_2B_6$) phase may be present in the alloy in an amount less than 1 weight %, about 2 weight % to about 5 weight %, more than 10 weight %, about 5 weight % to about 10 weight %, or more than 15 weight %, the $Co_DB_E$ (e.g., $Co_2B$ or $BCo_2$) phase may be present in the alloy in an amount greater than about 1 weight %, greater than about 2 weight %, or about 2 weight % to about 5 weight %; and the Co phase (e.g., substantially pure cobalt or a cobalt solid solution phase) may be present in the alloy in an amount less than 1 weight %, or less than 3 weight %. Any combination of the recited concentrations (or other concentrations disclosed herein) for the foregoing phases may be present in the alloy.

In an embodiment, when the alloying material(s) is phosphorous, the at least one Group VIII element is cobalt, and the substrate is a cobalt-cemented tungsten carbide substrate, the alloy may include a WC phase, a $Co_2P$ cobalt-phosphorous intermetallic compound phase, a Co phase (e.g., substantially pure cobalt or a cobalt solid solution phase), and optionally elemental phosphorous in various amounts or no elemental phosphorous. In such an embodiment, the phosphorous may be present with the cobalt in an amount of about 30 atomic % to about 34 atomic % of the alloy and, more specifically, about 33.33 atomic % of the alloy. According to one or more embodiments, the WC phase may be present in the alloy in an amount less than 1 weight %, or less than 3 weight %; the $Co_2P$ cobalt-phosphorous intermetallic compound phase may be present in the alloy in an amount greater than 80 weight %, about 80 weight % to about 95 weight %, more than 90 weight %, about 85 weight % to about 95 weight %, or about 95 weight % to about 99 weight %; and the Co phase (e.g., substantially pure cobalt or a cobalt solid solution phase) may be present in the alloy in an amount less than 1 weight %, or less than 3 weight %. Any combination of the recited concentrations (or other concentrations disclosed herein) for the foregoing phases may be present in the alloy.

As mentioned above, the canister may be generally configured such that a compact assembly may be positioned in the internal volume of the canister. FIG. 1 illustrates a canister 100 according to an embodiment. For example, the canister 100 may be sized and configured to contain and/or secure a compact assembly 120 therein. In some embodiments, the compact assembly 120 may include a sintered, preformed PCD table 121 bonded to or positioned near a substrate 122. For example, the compact assembly 120 may include a prefabricated PDC 130, which may include the substrate 122 and the PCD table 121 bonded thereto (e.g., the PDC 130 may be fabricated in a first HPHT process). As a further example, the PCD table 121 may be integrally formed with the substrate 122 or preformed in a first HPHT process and bonded to the substrate 122 in a second HPHT process. As described below in more detail, the compact assembly 120 may include an alloying material 123, which may be positioned adjacent to and/or in contact with the PCD table 121.

In some embodiments, the canister 100 may include multiple portions that may be assembled together to form or define the internal volume, which may be sized and configured to house the compact assembly 120. In the illustrated embodiment, the canister 100 includes a first container portion 140 and a second container portion 150. More specifically, for example, the first container portion 140 and/or second container portion 150 may have generally the same or similar shapes as the compact assembly 120 and may be size appropriately to facilitate placement of the compact assembly 120 in the internal volume formed thereby. In some embodiments, the compact assembly 120 may be generally cylindrical. Hence, the first container portion 140 and/or second container portion 150 may have generally cylindrical internal volumes defined by respective outer walls thereof. It should be appreciated that the compact assembly 120 may have any suitable shape (e.g., cuboid, ovoid, etc.) and the internal volumes of the first container portion 140 and second container portion 150 may have corresponding shapes to facilitate securing the compact assembly 120 therein.

Generally, the first container portion 140 and/or the second container portion 150 may have any suitable wall thickness, and such suitable walls may define the respective internal volumes of the first and second container portions 140, 150. In an embodiment, the wall thickness may be from about 0.005 inch to 0.015 inch. In alternative or additional embodiments, the wall thickness may be greater than 0.015 inch or less than 0.005 inch. Moreover, the first container portion 140 and second container portion 150 may have approximately the same wall thickness or may have different wall thicknesses. In any event, the respective thicknesses of the walls of the first container portion 140 and the second container portion 150 may be suitable for processing the compact assembly 120 (e.g., for subjecting the compact assembly 120 to an HPHT process).

According to the illustrated embodiment, a portion or section of the first container portion 140 may be positioned inside or extend at least partially into an internal volume of the second container portion 150. For example, the compact assembly 120 may be positioned in the internal volume of the first container portion 140 (e.g., the compact assembly 120 is enclosed by an outer wall 141 of the first container portion 140, which partially defines the internal volume of the first container portion 140). In some embodiments, a bottom 151 of the second container portion 150 may close the internal volume of the first container portion 140, which contains the compact assembly 120. In other words, an outer wall 152 of the second container portion 150 may surround the outer wall 141 of the first container portion 140, and the bottom 151 together with the outer wall 141 and a bottom 142 of the first container portion 140 may define the internal volume of the canister 100 that secures the compact assembly 120.

As mentioned above, the alloying material 123 may be positioned adjacent to and/or in contact with the PCD table 121. As such, the alloying material 123 may at least partially infiltrate the PCD table 121 during processing thereof (e.g., the alloying material 123 may alloy with at least one Group VIII metal occupying interstitial regions between the bonded diamond grains of the PCD table 121). Generally, the alloying material 123 may be in any suitable form, such as granular solids, liquids, gel, plate- or disc-like solids, etc. For example, the alloying material 123 may include phosphorous (e.g., white phosphorus, red phosphorous, violet phosphorous, black phosphorous, combinations thereof, etc.) and may be in a granular form.

In some embodiments, at least some of the alloying material 123 may at least partially surround the PCD table 121 (e.g., alloying material 123 may be adjacent to at least a portion of a side surface of the PCD table 121). In particular, the alloying material 123 may be positioned on a portion of or on substantially an entire upper surface 124 of the PCD table 121. Additionally or alternatively, the alloying material 123 may at least partially surround at least a portion of a peripheral surface 125 of the PCD table 121 (e.g., the surface that defines an outer shape of the PCD table 121). In an embodiment, the canister 100 may accommodate placement of the alloying material 123 in the interior volume, such that the alloying material 123 surrounds at least a portion of the peripheral surface 125 of the PCD table 121. For example, an interior side of an upper portion 143 of the wall 141 may be spaced apart from the peripheral surface 125 of the PCD table 121, such that at least some of the alloying material 123 may be positioned within the space between the interior side of the upper portion 143 and the peripheral surface 125 of the PCD table 121.

For example, the wall thickness at the upper portion 143 may be less than the wall thickness of the remaining or lower portion of the wall 141 (e.g., the inside space or diameter of the first container portion 140 at the upper portion 143 may be greater than the inside space or diameter of the 143 lower portion of the wall 141). Additionally or alternatively, the upper portion 143 may be flared, deformed, or swaged outward to produce a larger size or diameter at the upper portion 143, which may provide space between the interior side of the upper portion 143 and the peripheral surface 125 for the alloying material 123. In some embodiments, the upper portion 143 may extend between a top of the alloying material 123 and an interface between the PCD table 121 and the substrate 122 (e.g., the upper portion 143 may extend between the top of the alloying material 123 and a position not touching the interface between the PCD table 121 and substrate 122, such that the lower portion of the wall 141 may mask at least a portion of the PCD table 121 from the alloying material 123). In other words, at least a portion of the wall 141 may prevent the alloying material 123 from contacting at least a portion of the substrate 122 and/or an interface between the PCD table 121 and the substrate 122.

In any event, the second container portion 150 and the first container portion 140 may be closed and/or sealed together to define the internal volume of the canister 100, which may be assembled with and/or secure the compact assembly 120 (e.g., in a manner that positions at least some of the alloying material 123 adjacent to the upper surface 124 and about at least a portion of the peripheral surface 125 of the PCD table 121). Furthermore, the first container portion 140 and second container portion 150 may be connected together in a manner that provides a sealed environment inside the internal volume of the canister 100. For example, sealing the first container portion 140 and the second container portion 150 together may prevent air, other gases, or other contaminants from entering the internal volume of the canister 100. In some embodiments, before sealing the first container portion 140 and the second container portion 150, air and any other gas may be at least partially evacuated from the internal volume of the canister 100 and/or may be replaced with an inert gas (e.g., $CO_2$, Ar, He, one or more noble gases, or combinations of the foregoing), which may prevent or reduce oxidation during processing of the compact assembly 120.

In an embodiment, the first container portion 140 and the second container portion 150 may be sealed together by a joint 160, which may connect the first container portion 140 and second container portion 150 together and may seal the internal volume defined thereby, which may contain the compact assembly 120. For example, the joint 160 may be a welded joint (e.g., a fillet weld) or a braze joint, a bonded joint, a crimped joint, or any other suitable joint. The joint 160 may extend about an outer surface of the wall 141 and may connect a top or an edge of the wall 152 of the second container portion 150 to the outer surface of the wall 141. More specifically, for example, the joint 160 may seal the internal volume of the canister 100, which may prevent or reduce oxidation of the components or elements of the compact assembly 120 (e.g., prevent or reduce oxidation of the PCD table 121, alloying material 123, etc.).

Generally, the first container portion 140, the second container portion 150, and the joint 160 may include any number of suitable materials and combinations or alloys thereof. In at least one embodiment, the first container portion 140 and/or second container portion 150 includes a refractory metal material (e.g., niobium, molybdenum, tantalum, alloys thereof, etc.). The joint 160 may include one or more materials that may be similar to or different from the material of the first container portion 140 and/or second container portion 150. Additionally or alternatively, the joint 160 may be a braze joint including one or more suitable braze materials (e.g., copper, copper-silver, copper-zinc, etc.).

In some embodiments, the material for the joint 160 may be selected to have a suitable melting temperature or melting temperature range, such that during and/or after the joining of the first and second container portions 140, 150, the temperature of the alloying material 123 does not damage or change the properties of the alloying material (e.g., does not increase the temperature of the alloying material 123 above the degradation temperature thereof). For example, during the joining of the first and second container portions 140, 150, the alloying material 123 may be maintained at a temperature below 300° C., which is, for example, the ignition temperature of red phosphorous.

Figure 2:
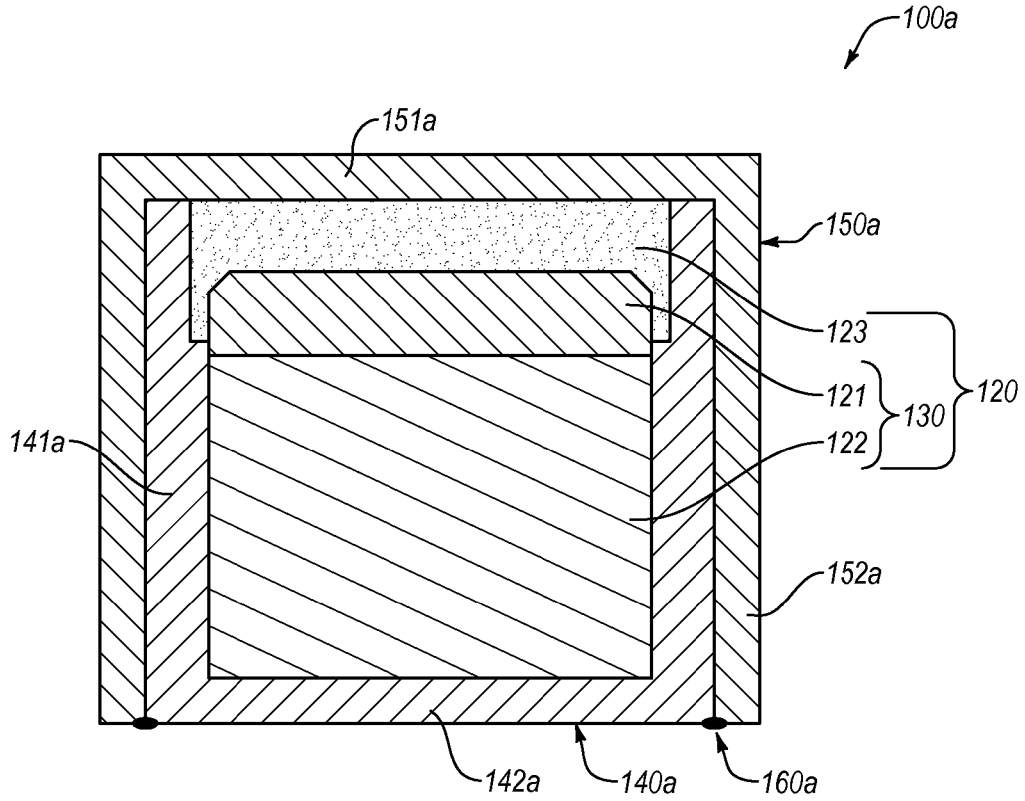
FIG. 2 is cross-sectional view of a canister and a compact assembly positioned in an internal volume of the canister according to another embodiment.

The joint between the first and second portions of the canister may be formed at any number of suitable locations. For example, as shown in FIG. 2, a canister **100*a* may include a first container portion 140*a* positioned or located within an internal volume of a second container portion 150*a*. Except as described herein, the canister 100*a* and its features, components, elements, or materials may be similar to or the same as the canister 100 (FIG. 1**) and its respective features, components, elements, and materials.

In at least one embodiment, a wall 152*a* of the second container portion 150*a* may extend from a bottom 151*a* to an outer surface of a bottom 142*a* of the first container portion 140*a*. For example, the distance between an inner surface of the bottom 151*a* of the second container portion 150*a* and an edge of the wall 152*a* may be similar to or the same as the height of the first container portion 140 (which may be defined by a wall 141*a* of the first container portion 140*a*). In an embodiment, a joint 160*a* may be placed between the wall 152*a* (e.g., edge of the wall 152) and the bottom 142*a* (e.g., at about outer surface of the bottom 142).

In any case, the sealed internal volume of the canister 100*a*, defined by the connected first container portion 140*a* and second container portion 150*a*, may secure the compact assembly 120 therein. As mentioned above, when sealing the first container portion 140*a* and second container portion 150*a* together, the temperature of the alloying material 123 may be optionally maintained below a selected temperature, such as the ignition temperature.

Figure 3:
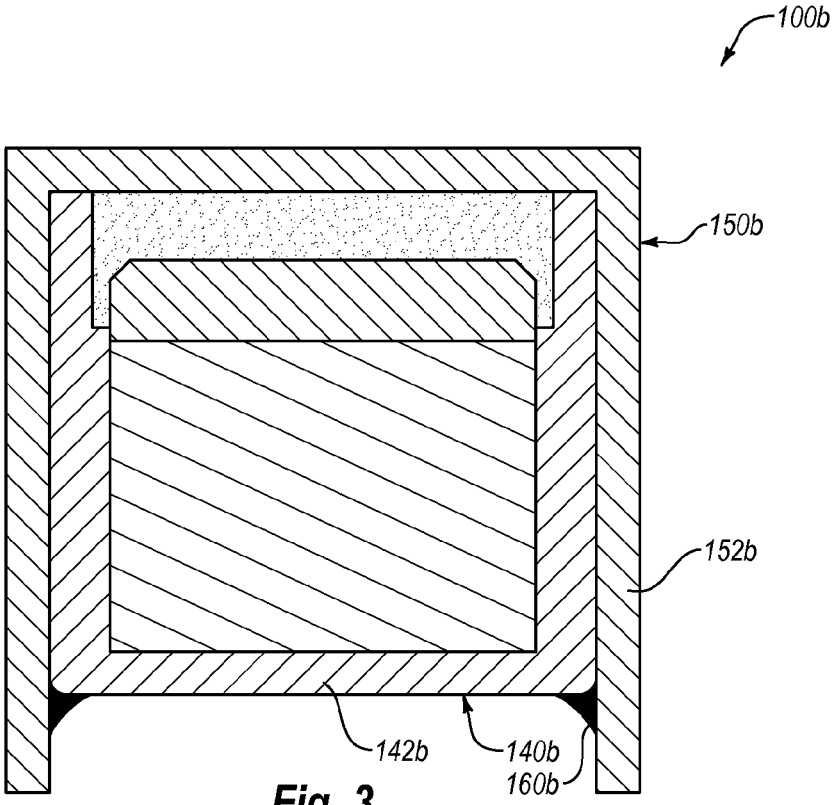
FIG. 3 is cross-sectional view of a canister and a compact assembly positioned in an internal volume of the canister according to yet another embodiment.

As shown in FIG. 3, a canister 100*b* may include a first container portion 140*b* positioned inside an internal volume of a second container portion 150*b*, such that wall 152*b* of the second container portion 150*b* extends past a bottom 142*b* of the first container portion 140*b*, according to an embodiment. Except as described herein, the canister 100*b* and its features, components, elements, or materials may be similar to or the same as any of the canisters 100, 100*a* (FIGS. 1-2) and their respective features, components, elements, and materials. In the illustrated embodiment, the first container portion 140*b* and the second container portion 150*b* may be sealed and/or connected together by a joint 160*b* (e.g., a welded joint or a braze joint), which may be between an interior surface of wall 152*b* of the second container portion 150 and outer surface of bottom 142*b* of the first container portion 140*b* (e.g., at least a portion of the wall 152 may protrude past the outer surface of the bottom 142*b* of the first container portion 140*b*).

Figure 4A:
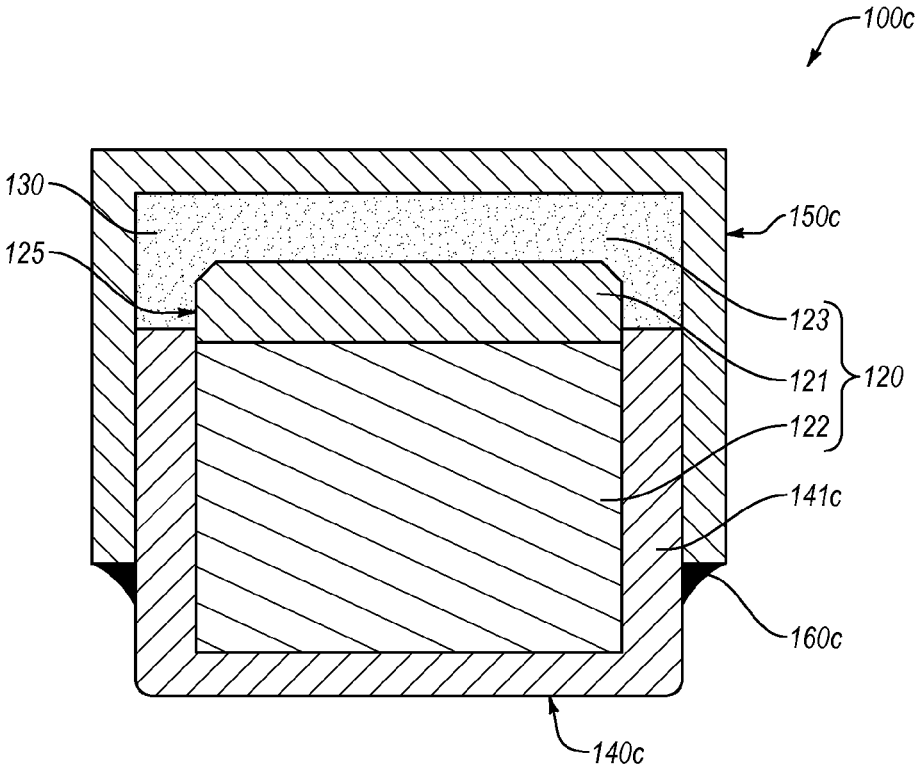
FIG. 4A is cross-sectional view of a canister and a compact assembly positioned in an internal volume of the canister according to at least one embodiment.

As noted above, the compact assembly and the alloying material(s) may be positioned in the internal volume of the same portion of the canister (e.g., such that the other portion of the canister closes the internal volume of the portion containing the compact assembly and the additive). As shown in FIG. 4A, a canister 100*c* may include first container portion 140*c* and second container portion 150*c* that define an internal volume thereof containing the compact assembly 120, according to an embodiment. Except as described herein, the canister 100*c* and its features, components, elements, or materials may be similar to or the same as any of the canisters 100, 100*a*, 100*b* (FIGS. 1-3) and their respective features, components, elements, and materials. In the illustrated embodiment, one or more portions of compact assembly 120 (e.g., the substrate 122 and/or a portion of or the entire PCD table 121) is retained generally within the internal volume of the first container portion 140*c*, and at least a portion of the compact assembly 120 is retained generally within the internal volume of the second container portion 150*c* (e.g., a portion of or the entire PCD table 121, the alloying material 123, etc.).

For example, the thickness of wall 141*c* of the first container portion 140*c* may form or provide a space between an interior surface of wall 152 of the second container portion 150 and the peripheral surface 125 of the PCD table 121. In other words, after positioning the first container portion 140*c* inside the internal volume of the second container portion 150*c* (or positioning the second container portion 150*c* over the first container portion 140*c*) the interior surface of the wall 152 may be spaced from the peripheral surface 125 of the PCD table 121 by the thickness of the wall 141*c* of the first container portion 140*c*. The space or volume formed between the internal surface of the wall 152*c* and the peripheral surface 125 may be at least partially filled with the alloying material 123. In some embodiments, the first container portion 140*c* and the second container portion 150*c* may be connected and sealed together in the same manner as the first container portion 140 and the second container portion 150 (FIG. 1). For example, a joint 160*c* (e.g., a welded joint or a braze joint) may connect together and seal the first and second container portions 140*c*, 150*c*. Alternatively or additionally, the first container portion 140*c* and second container portion 150*c* may be configured, sized, and connected together in a similar manner to any of the container portions described herein.

Figure 4B:
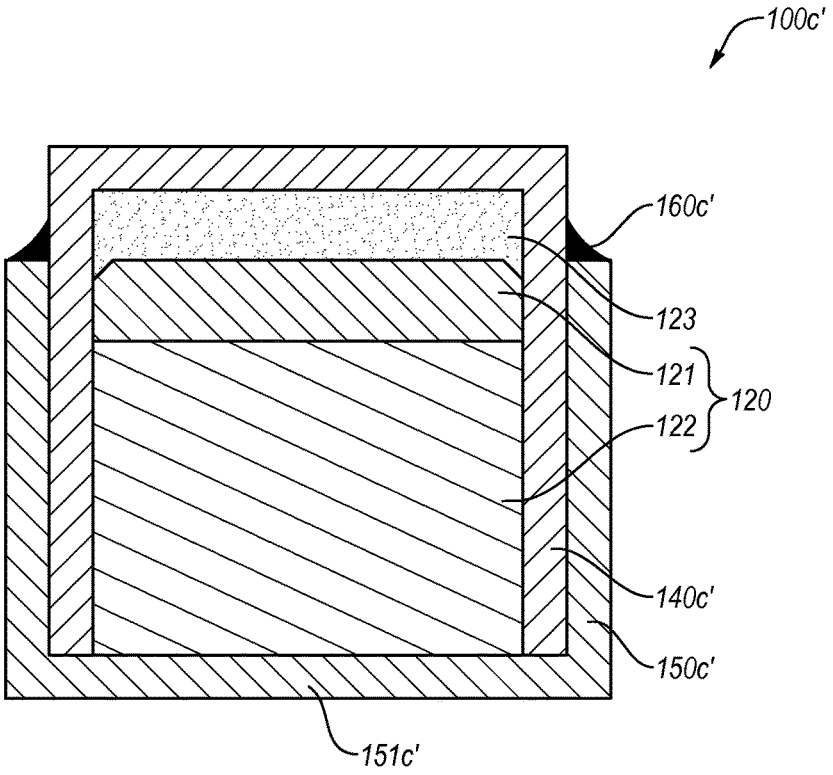
FIG. 4B is a cross-sectional view of a canister and a compact assembly positioned in an internal volume of the canister according to an embodiment.

Generally, the weld between the first and second container portions (e.g., between inner and outer container portions, where the inner container portion is closer to and/or in contact with the compact assembly) may be positioned at any location relative to the alloying material 123. Moreover, in some embodiments, the alloying material 123 and/or the PCD table 121 may be positioned in the outer container portion (e.g., in the second container portion 150*c*). Alternatively, according to at least one embodiment shown in FIG. 4B, a canister 100*c*' may be configured such that the alloying material 123 is positioned inside the inner container portion of the canister 100*c*'. Except as described herein, the canister 100*c*' and its features, components, elements, or materials may be similar to or the same as any of the canisters 100, 100*a*, 100*b*, 100*c* (FIGS. 1-4A) and their respective features, components, elements, and materials.

In an embodiment, the alloying material 123, the PCD table 121, the substrate 122, or combinations thereof may be positioned inside a first container portion 140*c*' (e.g., in the inner container portion). For example, at least a portion of the first container portion 140*c*', together with one or more portions of the alloying material 123, the PCD table 121, the substrate 122, or combinations thereof, may be positioned inside a second container portion 150*c*'. In some embodiments, a bottom 151*c*' of the second container portion 150*c*' may be positioned near and/or in contact with a bottom of the substrate 122. In at least one embodiment, the first and second container portions 140*c*' and 150*c*' may be connected and/or sealed together with a weld 160*c*' (e.g., as described above).

Figure 5:
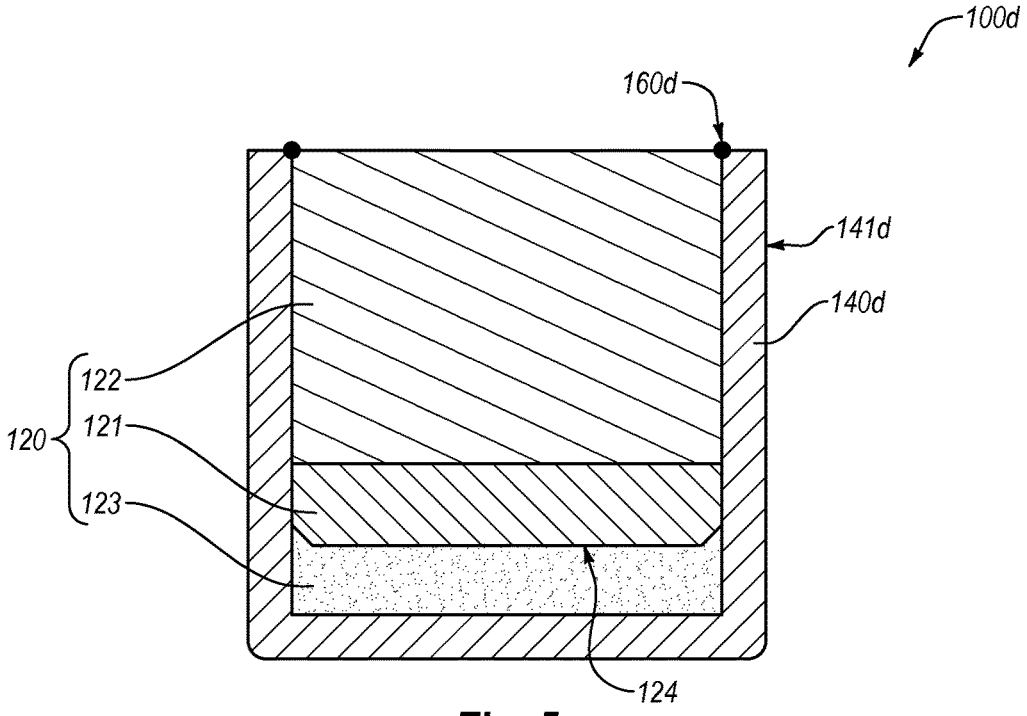
FIG. 5 is cross-sectional view of a canister and a compact assembly positioned in an internal volume of the canister according to one or more other embodiments.

FIG. 5 illustrates a cross-sectional view of a canister 100*d* according to an embodiment. More specifically, in the illustrated embodiment, the compact assembly 120 is attached to and/or defines at least a portion of the canister 100*d*. Except as described herein, the canister 100*d* and its features, components, elements, or materials may be similar to or the same as any of the canisters 100, 100*a*, 100*b*, 100*c*, 100*c*' (FIGS. 1-4B) and their respective features, components, elements, and materials.

For example, the canister 100*d* may include a first container portion 140*d* and the substrate 122 of the compact assembly 120 may be attached and/or seal together with the first container portion 140*d*. In an embodiment, a joint 160*d* (e.g., a welded joint or a braze joint) may be placed at and/or near the substrate 122 and a wall 141*d* of the first container portion 140*d* (e.g., at and/or near a bottom of the substrate 122 and at and/or near an edge of the wall 141*d*). Furthermore, the internal volume of the canister 100*d* may be defined by the internal volume of the first container portion 140*d*, by the joint 160*d* and by at least a portion of the substrate 122. In an embodiment, the internal volume of the canister 100*d* may contain at least the PCD table 121 and alloying material 123 positioned adjacent to the upper surface 124 of the PCD table 121.

Figure 6A:
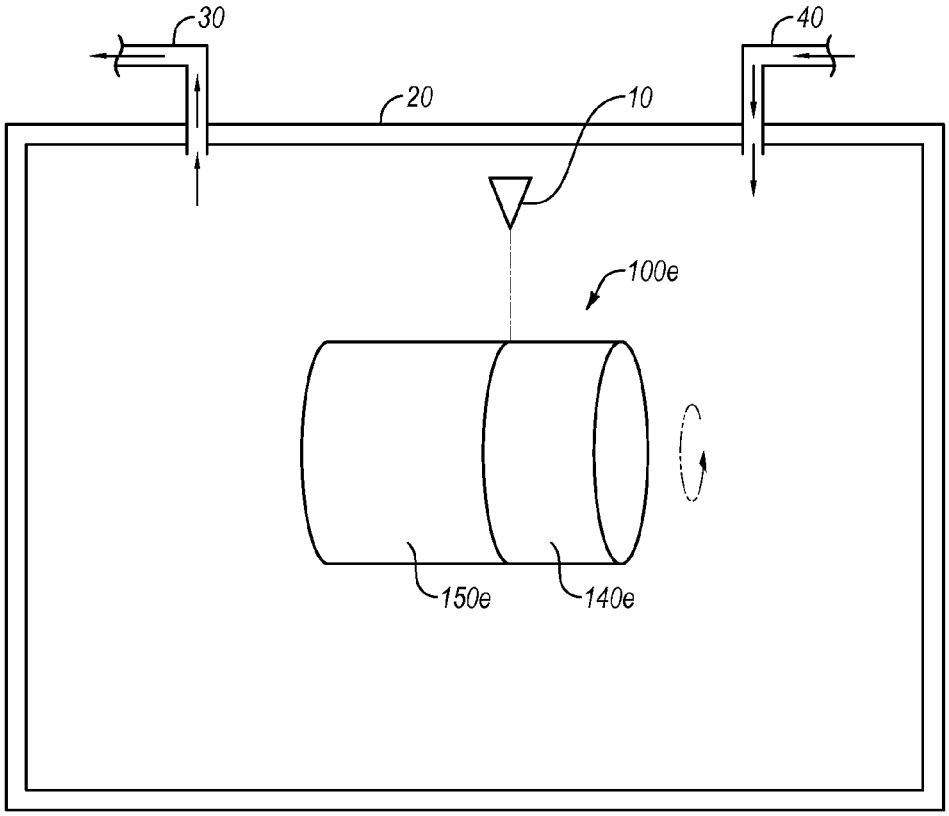
FIG. 6A is a schematic diagram of a canister positioned in a chamber according to an embodiment.

As noted above, air and/or other gases (e.g., reactive gases) may be at least partially evacuated from the internal volume of the container, to reduce or eliminate oxidation or other contamination or reaction of the chemical elements or components of the compact assembly during processing thereof. As shown in FIG. 6A, air may be evacuated from a canister 100*e*, and first container portion 140*e* and second container portion 150*e* (of the canister 100*e*) may be welded and/or sealed together with a laser 10. Except as described herein, the canister 100*e* and its features, components, elements, or materials may be similar to or the same as any of the canisters 100, 100*a*, 100*b*, 100*c*, 100*d* (FIGS. 1-5) and their respective features, components, elements, and materials.

In an embodiment, the canister 100*e* may be rotated as the laser 10 welds (e.g., autogenously welds) and seals the first container portion 140*e* and second container portion 150*e* together, thereby forming the sealed internal volume of the canister 100*e*, which may contain the compact assembly. Moreover, in an embodiment, the canister 100*e* may be placed inside a chamber 20, which may provide a suitable environment for welding together the second container portion 150*e* and first container portion 140*e*. In particular, according to at least one embodiment, air may be evacuated from the chamber 20 and from the internal volume of the canister 100*e* through an outlet 30 to a suitable partial vacuum level such as a vacuum of at least about $10^{-2}$ torr, about $10^{-3}$ torr to about $10^{-9}$ torr, about $10^{-2}$ torr to about $10^{-5}$ torr, about $10^{-5}$ torr to about $10^{--9}$ torr, or less than about $10^{-9}$ torr. Additionally or alternatively, an inert gas (e.g., argon, helium, nitrogen, carbon dioxide, any other inert gas, or combinations thereof) may be introduced into the chamber 20 (e.g., after pulling vacuum) and into the internal volume of the canister 100*e* (e.g., the air in the chamber 20 and/or in the internal volume of the canister 100*e* may be replaced with one or more inert gasses). For example, the inert gas may be introduced into the chamber 20 after pulling vacuum and into the internal volume of the canister 100*e* through an inlet 40 in the chamber 20. In any event, as described above, the compact assembly may be sealed inside the internal volume of the canister 100*e*, which may have at least partial vacuum and/or one or more inert gasses therein.

Figure 6B:
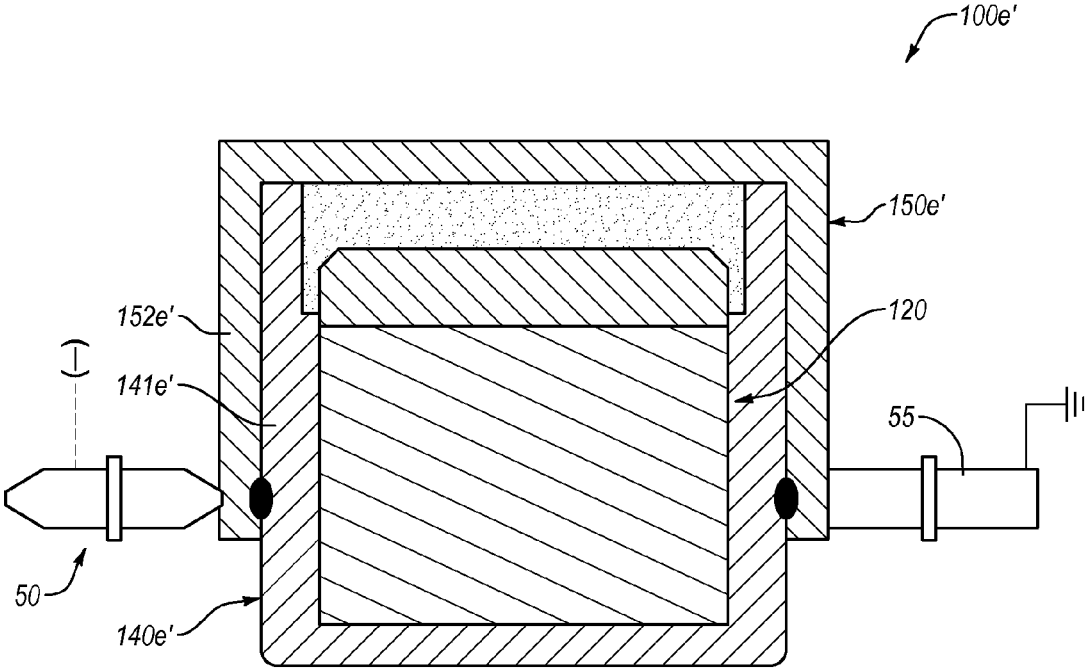
FIG. 6B is a schematic illustration of a canister having portions thereof resistance welded together according to an embodiment.

It should be appreciated that two or more container portions may be rotated and welded together with any number of suitable welding techniques. For example, two or more container portions may be spot or resistance welded together. FIG. 6B is a schematic illustration of a canister 100*e*' having container portions thereof welded together by a resistance welder, according to an embodiment. Except as described herein, the canister 100*e*' and its features, components, elements, or materials may be similar to or the same as any of the canisters 100, 100*a*, 100*b*, 100*c*, 100*d*, 100*e* (FIGS. 1-6A) and their respective features, components, elements, and materials.

In an embodiment, the resistance welder may include a first roller 50 and a second roller 55, which collectively may apply pressure onto the container portions of the canister 100*e*' and may weld the container portions together. For example, the canister 100*e*' may include first and second container portions 140*e*', 150*e*'. The canister 100*e*' may be positioned between the first and second rollers 50, 55, such that the first and second rollers 50, 55 apply pressure onto a wall 152*e*' of the second (or outer) container portion 150*e*', and press the wall 152*e*' against a wall 141*e*' of the first container portion 140*e*'. Moreover, the resistance welder may include a power supply that may apply electrical energy to the location of contact between the walls 152*e*' and the first and/or second rollers 50, 55. For example, the power supply may supply electrical energy such that the current may flow from the first roller 50 to the second roller 55 and the resistance heating generated by the current causes the first and second container portions 140*e*', 150*e*' to become resistance welded together.

More specifically, for example, the current flow from the first roller 50 to the second roller 55 may pass through the first and second container portions 140*e*', 150*e*' (e.g., starting at the point or location of contact between the first roller 50 and the wall 152*e*' of the second container portion 150*e*'). Due to the electrical resistance of the material comprising the first and second container portions 140*e*', 150*e*', as the current passes therethrough, the first and/or second portions 140*e*', 150*e*' may be heated. For example, such heating may be greatest at the point or location of contact between the first roller 50 and the wall 152*e*' of the second container portion 150*e*' and may be sufficient to melt or soften the material of the walls 152*e*', 141*e*' in a manner that joins or welds together the walls 152*e*', 141*e*' (e.g., at location or region of highest temperature increase, such as at and/or near the location or region of contact between the first roller 50 and the wall 152*e*' of the second container portion 150*e*').

In some embodiments, the first and/or second container portions 140*e*', 150*e*' may be generally cylindrical. In an embodiment, the first and second container portions 140*e*', 150*e*' may be rotated together and in contact with the first and/or second rollers 50, 55 to seam weld together the first and second container portions 140*e*', 150*e*', in a manner described above. For example, the first and/or second rollers 50, 55 may be rotated to rotate the first and/or second container portion 140*e*', 150*e*' (e.g., the pressure applied by the first roller 50 onto the wall 152*e*' of the second portion 150*e*' and corresponding frictional forces therebetween may be sufficient or suitable for transferring rotational torque from the roller 50 to the wall 152*e*', thereby rotating the second canister portion 152*e*'. As described above, as the first and second container portions 140*e*', 150*e*' rotate together with the first and second rollers 50, 55, the electrical current passing therethrough may weld together the first and second container portions 140*e*', 150*e*' (e.g., forming a seam weld therebetween).

Figure 7A:
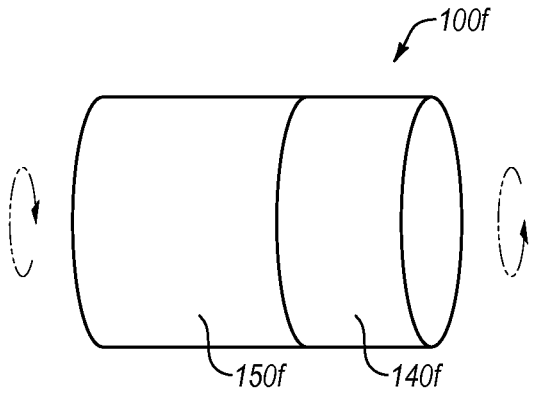
FIG. 7A is a schematic view of a canister according to an embodiment.

In some embodiments, the portions of the container may be friction welded together. For example, as shown in FIG. 7A, first and second container portions 140*f*, 150*f* (of container 100*f*) may be rotated relative to each other. Except as described herein, the canister 100*f* and its features, components, elements, or materials may be similar to or the same as any of the canisters 100, 100*a*, 100*b*, 100*c*, 100*c*', 100*d*, 100*e*, 100*e*' (FIGS. 1-6B) and their respective features, components, elements, and materials.

In an embodiment, the first and second container portions 140*f*, 150*f* may be rotated in opposing directions. Alternatively, one of the first and second container portions 140*f*, 150*f* may rotate relative to another, but in the same direction. In any event, relative rotation of the first and second container portions 140*f*, 150*f* may generate sufficient heat at one or more locations of contact therebetween to form a weld therebetween. In some embodiments, in addition to rotating the first and second container portions 140*f*, 150*f*, the first and second container portions 140*f*, 150*f* may be axially pressed against each other during rotation. Moreover, such generated heat may be sufficient to melt or at least partially soften the material of the first and/or second container portions 140*f*, 150*f*, thereby welding together the first and second container portions 140*f*, 150*f*.

Figure 7B:
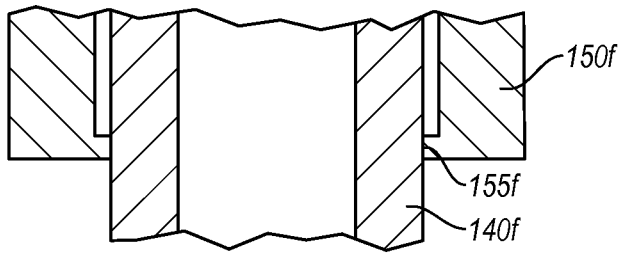
FIG. 7B is a cross-sectional view of the canister of FIG. 7A.

In one or more embodiments, the contact location(s) between the first and second container portions 140*f*, 150*f* may be generally isolated, to promote localized friction and corresponding localized temperature increase at the selected location(s) of the first and second container portions 140*f*, 150*f*. For example, as shown in FIG. 7B, the second container portion 150*f* may include a lip or standoff 155*f*, which may generally contact outer surface of the first container portion 140*f*. In an embodiment, the friction between the standoff 155*f* and the outer surface of the first container portion 140*f*, during the relative rotation between the first and second container portions 140*f*, 150*f*, the frictional heat generated therebetween may be generally localized to the region of the contact between the standoff 155*f* and the outer surface of the first container portion 140*f*. In any event, friction between the first and second container portions 140*f*, 150*f* may melt or soften one or more locations thereon (e.g., the friction may melt or soften the standoff 155*f*), thereby welding and sealing together the first and second container portions 140*f*, 150*f*. It should be also appreciated that the frictional contact between the first and second container portions 140*f*, 150*f* may be positioned at any suitable location and/or may be localize with any number of suitable features, which may vary from one embodiment to the next.

Figure 7C:
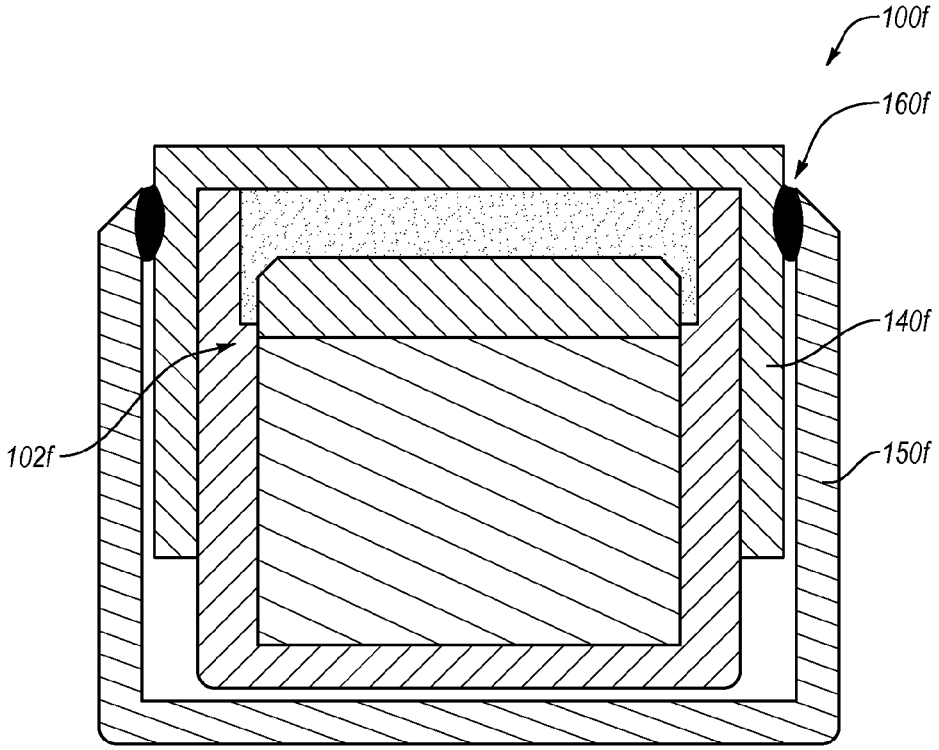
FIG. 7C is a cross-section view of a sealed canister of FIG. 7A.

FIG. 7C illustrates the canister 100*g* with the first and second container portions 140*f*, 150*f* connected or welded together at weld 160*f*. In particular, as described above, frictional relative rotation between the first and second container portions 140*f*, 150*f* may generate sufficient heat to at least partially melt at least a region of the first and/or second portions 140*f*, 150*f*, thereby forming the weld 160*f* therebetween after the heated region(s) cool to a temperature of solidification of the respective materials thereof. It should be also appreciated that numerical identifiers for the container portions, such as "first," "second," etc., are used for descriptive purposes only and are not intended to connote an order or relative position of container portions. For example, the first and/or second container portions may be positioned adjacent to and/or in contact with compact assembly. Alternatively, the first and/or second container portions, such as the first and/or second container portions 140*f*, 150*f* may be at least partially separated from compact assembly 120*f* (e.g., by one or more container portions).

Figure 8:
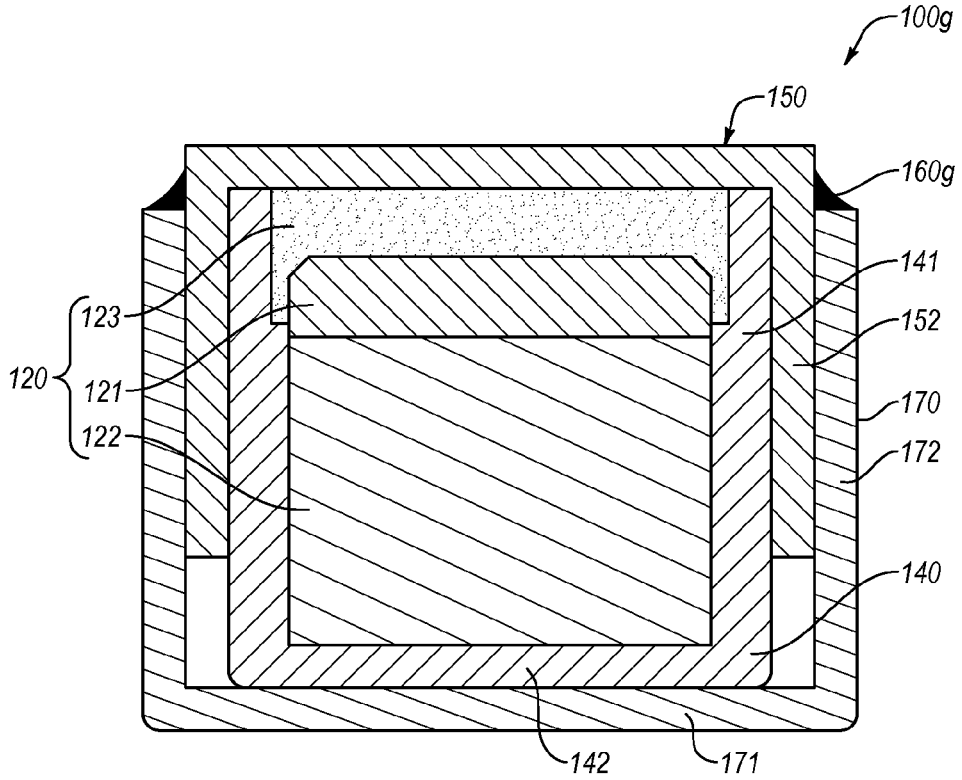
FIG. 8 is cross-sectional view of a canister and a compact assembly positioned in an internal volume of the canister according to an embodiment.

Generally, the container may include any number of portions, which may be arranged in any number of suitable configurations to form or define an internal space of the container, which may house the compact assembly and/or the additive. In an embodiment, as shown in FIG. 8 a canister 100*g* may include three portions connected together to form the internal volume of the canister 100*g*. Except as otherwise described herein, the canister 100*g* and its feature, elements, components, or materials may be similar to or the same as any of the canisters 100, 100*a*, 100*b*, 100*c*, 100*d*, 100*e*, 100*f* (FIGS. 1-7B) or their corresponding features, elements, components, and materials. For example, the canister 100*g* may include the first container portion 140 and the second container portion 150 arranged in a manner described above (in connection with FIG. 1). More specifically, according to at least one embodiment, the first container portion 140 may be positioned at least partially inside the second container portion 150, such that the first container portion 140 and the second container portion 150 form or define the internal volume of the canister 100*g*, which may house the compact assembly 120 (e.g., the PCD table 121, the substrate 122, the alloying material 123, etc.).

Moreover, in some embodiments, the canister 100*g* may include a third container portion 170, which may be sized, shaped, and otherwise configured to secure at least a portion of the first container portion 140 and/or the second container portion 150 (e.g., assembled together). In other words, the third container portion 170 may define an internal volume that may accept the first container portion 140 and the second container portion 150 assembled together and securing the compact assembly 120. For example, the bottom 142 of the first container portion 140 may be positioned on a bottom 171 of the third container portion 170 (e.g., such that the outer surface of the bottom 142 is at least partially in contact with an interior surface of the bottom 171 of the third container portion 170).

In some embodiments, positioning the compact assembly 120 within the internal volume of the canister 100*g* may separate one or more portions of the compact assembly 120 by three layers or walls (e.g., the wall 141 of the first container portion 140, the wall 152 of the second container portion 150, and wall 172 of the third container portion 170). As described above, in some embodiments, air or other gases/contaminants may be evacuated from the internal volume of the canister 100*g*, and the first container portion 140, the second container portion 150, the third container portion 170, or combinations thereof may be sealed together to inhibit or prevent reentry of air or gases into the internal volume of the canister 100*g* and/or exit of inert gas therefrom.

In an embodiment, the canister 100*g* may include a joint 160*g* (e.g., a welded joint or a braze joint) that may secure together the second container portion 150 and third container portion 170, thereby also securing the first portion 140 relative to the second portion 150 and sealing the internal volume of the canister 100*g*. For example, the joint 160*g* may connect together the wall 152 of the second container portion 150 and the wall 172 of the third container portion 170. As described above, however, any number of joints may connect together any suitable portions of the canister 100*g*. In some embodiments, the joint 160*g* may include material that has a melting temperature or melting temperature range that is lower than the degradation temperature of the alloying material 123 (e.g., to prevent or minimize the risk of reacting or degrading the alloying material 123 while joining the second container portion 150 and the third container portion 170).

In one or more embodiments, the canister 100*g* may include one or more insulation materials that may be positioned between any of the walls 141, 152, 172, or combinations thereof. In particular, the insulation materials may prevent or limit heat transfer from the joint location (e.g., location where heat is applied to melt the joint material and/or the second and third container portions 150, 170) toward or to the alloying material 123. Moreover, in some embodiments, the joint 160*g* may be positioned away from the alloying material 123 (e.g., near a surface of the PCD table 121 that faces away from the alloying material 123). In any event, the internal volume of the canister 100*g* may be sealed in a manner that maintains the temperature of the alloying material 123 below the degradation temperature thereof.

Figure 9:
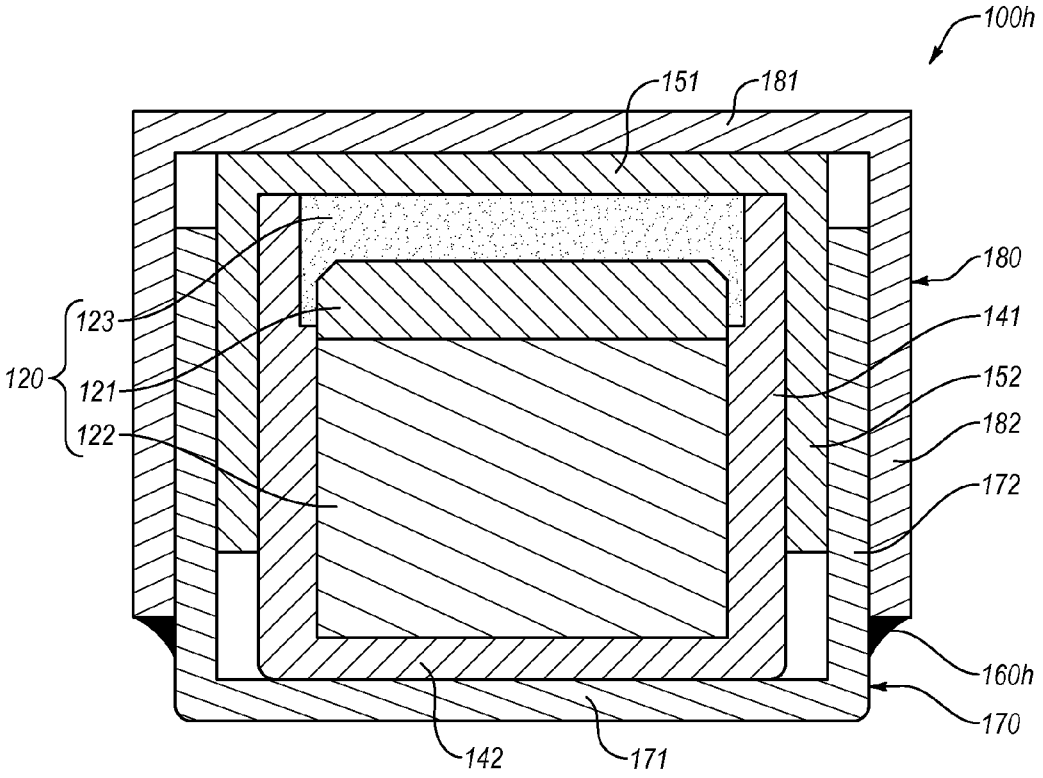
FIG. 9 is cross-sectional view of a canister and a compact assembly positioned in an internal volume of the canister according to an embodiment.

Again, the container may have any number of portions that connect together and/or at least partially positioned one within another. For example, such arrangement may provide additional layers or walls that separate the compact assembly from external environment and/or provide additional insulation or inhibit heat transfer between a joint location and the alloying material in the internal volume of the container. As shown in FIG. 9, a canister 100*h* may include four container portions, according to an embodiment. Except as otherwise described herein, the canister 100*h* and its feature, elements, components, or materials may be similar to or the same as any of the canisters 100, 100*a*, 100*b*, 100*c*, 100*d*, 100*e*, 100*f*, 100*g* (FIGS. 1-8) or their corresponding features, elements, components, and materials.

More specifically, in the illustrated embodiment, the canister 100*h* includes the first container portion 140 at least partially positioned in the internal volume of the second container portion 150, which is at least partially positioned in the internal volume of the third container portion 170; and the third container portion 170 is at least partially positioned in an internal volume of a fourth container portion 180. For example, the first container portion 140 and the second container portion 150 may be assembled together in a manner described above (e.g., in connection with FIGS. 1 and 8), such as to form or define the internal volume of the canister 100*h* that contains the compact assembly 120. Moreover, as described above (e.g., in connection with FIG. 8), the first container portion 140 and second container portion 150 together with the compact assembly 120 may be at least partially positioned inside the internal volume of the third container portion 170.

In some embodiments, the first container portion 140, second container portion 150, third container portion 170 (e.g., together with the compact assembly 120 and alloying material 123) may be at least partially positioned in the internal volume of the fourth container portion 180. For example, the bottom 151 of the second container portion 150 may be near and/or in contact with a bottom 181 of the fourth container portion 180 (e.g., the outer surface of the bottom 151 maybe at least in partial contact with the interior surface of the bottom 181). Furthermore, in at least one embodiment, to seal the internal volume of the canister 100*h*, the fourth container portion 180 may be connected to or sealed together with the third container portion 170. For example, a joint 160*h* (e.g., a welded joint or braze joint) may connect wall 182 of the fourth container portion 180 to the wall 172 of the third container portion 170, thereby sealing the internal volume of the canister 100*h* (e.g., after evacuating air from the internal volume of the canister 100*h*).

As mentioned above, while joining one or more portions of the canister 100*h*, the temperature of the alloying material 123 may be maintained below the degradation temperature thereof. For example, additional layers or walls between the joint 160*h* and the alloying material 123 (e.g., walls 141, 152, 172, 182 may provide insulation and/or impede heat transfer between the location of the joint 160*h* and the alloying material 123). Moreover, in the illustrated embodiment, the joint 160*h* is positioned away from the location of the alloying material 123 (e.g., the joint 160*h* may be positioned near the side or surface of the substrate that faces away from the alloying material 123). In an embodiment, the distance between the location of the joint 160*h* and the alloying material 123, the layers or walls therebetween, the insulation or thermal resistance therebetween (impeding heat transfer from the location of the joint 160*h* to the alloying material 123), a melting temperature of the joint material, or any combination of the forgoing may be selected such that the temperature of the alloying material 123 is maintained below a degradation temperature of the alloying material 123.

Figure 10:
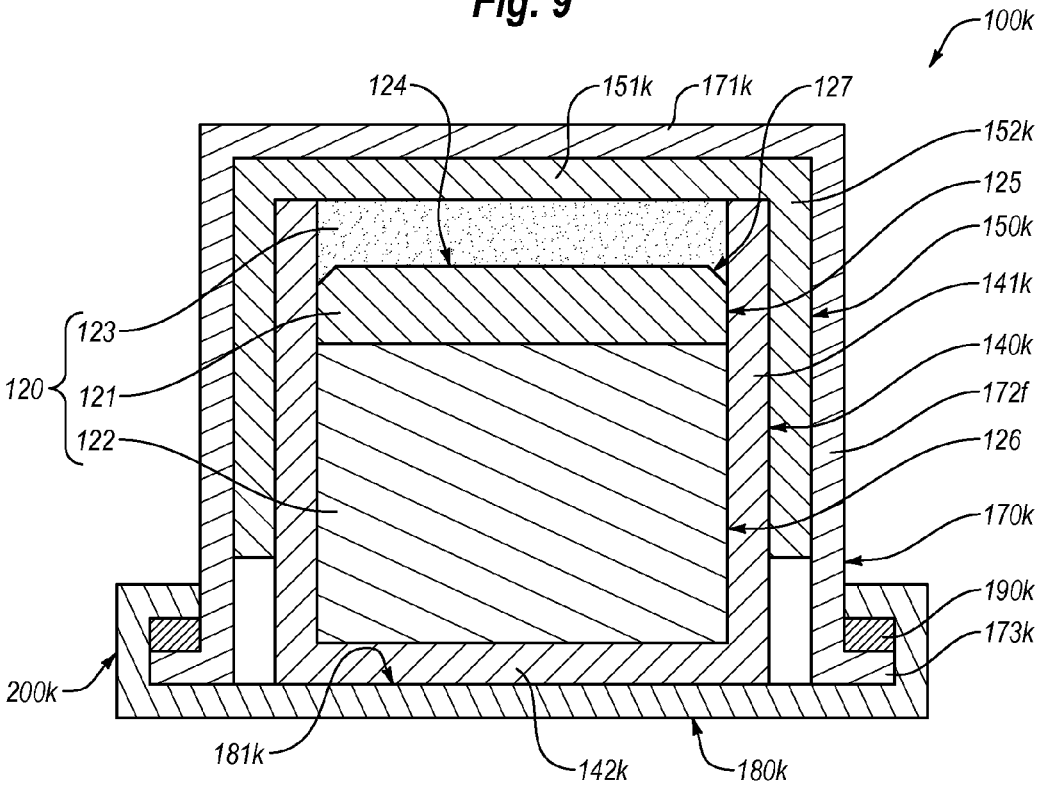
FIG. 10 is cross-sectional view of a canister and a compact assembly positioned in an internal volume of the canister according to another embodiment.

As mentioned above, one or more of the container portions may be connected and/or sealed together in any number of suitable ways and/or with any number of suitable mechanisms (e.g., some of which may involve producing a seal substantially without heating the sealed container portions and/or without elevating the temperature of the alloying material to a selected temperature). FIG. 10 illustrates a canister 100*k* that includes a seam seal which may be fabricated without substantial rise in the temperature of connected container portions, according to at least one embodiment. Except as otherwise described herein, the canister 100*k* and its feature, elements, components, or materials may be similar to or the same as any of the canisters 100, 100*a*, 100*b*, 100*c*, 100*d*, 100*e*, 100*f*, 100*g*, 100*h* (FIGS. 1-9) or their corresponding features, elements, components, and materials.

In an embodiment, the canister 100*k* may include first container portion 140*k* and second container portion 150*k*, which may form or define an internal volume of the canister 100*h*. For example, as described above, the compact assembly 120 may be positioned in the internal volume of the canister 100*k* and may be sealed in an inert environment. In some embodiments, the first container portion 140*k* may have a wall 141*k* that substantially surrounds the compact assembly 120 (e.g., the interior surface of the wall 141*k* may be adjacent to and/or in contact with peripheral surfaces 125, 126 of the PCD table 121 and/or substrate 122). Furthermore, the wall 141*k* may extend past the upper surface 124 of the PCD table.

In one or more embodiments, the alloying material 123 may be positioned adjacent to or on the upper surface 124 of the compact assembly 120. In some embodiments, the PCD table 121 may include a chamfer 127, which may span about or encircle at least a portion of the upper surface 124. Hence, in some embodiments, the alloying material 123 positioned inside the internal volume of the canister 100*k* may be adjacent to and/or in contact with the upper surface 124, the side surface 125, and/or with the chamfer 127 of the PCD table 121. For example, the peripheral surface 126 of the substrate 122 may be masked from the alloying material 123 by the wall 141*k* of the first container portion 140, such as to prevent or impede the alloying material 123 from infiltrating the substrate 122 at the peripheral surface 126. Additionally or alternatively, the compact assembly 120 may have an approximately sharp corner or edge formed between the upper surface 124 and the peripheral surface 125. In some embodiments, the alloying material 123 may be positioned only adjacent to or in contact with at least a portion of the upper surface 124 and/or at least a portion of side surface 125 of the compact assembly 120.

In at least one embodiment, as described above, the first container portion 140*k*, the second container portion 150*k* and the compact assembly 120 contained therein may be positioned inside one or more additional container portions (e.g., inside third and fourth container portions 170*k*, 180*k*). In particular, for example, the first container portion 140*k* and second container portion 150*k* (assembled together) may be positioned in internal volume of the third container portion 170*k* (e.g., the outer surface of bottom 152 of the second container portion 150*k* is adjacent to and/or in contact with interior surface of bottom 171*k* of the third container portion 170*k*). In an embodiment, the canister 100*k* includes the fourth container portion 180*k*, which may cap or close the internal volume of the third container portion 170*k* and seal the first and second container portions 140*k*, 150*k* therein. For example, an inward facing surface 181*k* of the fourth container portion 180*k* may be positioned adjacent to and/or in contact with the outer surface of bottom 142*k* of the first container portion 140*k*.

In some embodiments, the third container portion 170*k* and the fourth container portion 180*k* may be connected and/or sealed together in a manner that seals the internal volume of the canister 100*k*. For example, a seam structure 200*k* may be formed by and between the third container portion 170*k* and fourth container portion 180*k*. In particular, as described above, air may be at least partially evacuated from the internal volume of the canister 100*k*, and the internal volume may be sealed such as to prevent or impede air or oxidants from entering the internal volume of the canister 100*k*.

In an embodiment, the third container portion 170*k* may include a flange 173*k*, which may extend outward from an outer surface of a wall 172*k* of the third container portion 170*k*. In some embodiments, before forming the seam structure 200*k*, the fourth container portion 180*k* may have an approximately planar or plate-like configuration. To form the seam structure 200*k*, one or more portions of the unattached fourth container portion 180*k* may be bent (e.g., plastically deformed) about the flange 173*k* of the third container portion 170*k*, thereby securing and/or sealing together the third and fourth container portions 170*k*, 180*k*.

In one or more embodiments, the seam structure 200*k* may include a sealing shim or washer 190*k*. For example, the sealing washer 190*k* may be plastically or elastically deformed between the flange 173*k* and the folded portion(s) of the fourth container portion 180*k* to produce a seal that may prevent or impede air from entering the internal volume of the canister 100*k* (e.g., thereby producing an airtight seal between the third and fourth container portions 170*k*, 180*k*). Alternatively, the sealing washer 190*k* may be substantially rigid, such as compression thereof between the flange 173*k* of the third container portion 170*k* and the folded portion(s) of the fourth container portion 180*k* may not produce substantial deformation of the sealing washer 190*k* (e.g., after attachment of the third container portion 170*k* and fourth container portion 180*k*, the flange 173*k* and/or the folded portion(s) of the fourth container portion 180*k* may be exhibit more deformation than the sealing washer 190*k*). In some embodiments, the sealing washer 190*k* may include or comprise a braze material (e.g., copper, brass, bronze, aluminum, steel, etc.). Furthermore, in some embodiments, the sealing washer 190*k* may comprise a refractory metal material, etc. In any event, in some embodiments, the sealing washer 190*k* may improve the seal between the third container portion 170*k* and fourth container portion 180*k* (produced by the seam structure 200*k*).

Figure 11:
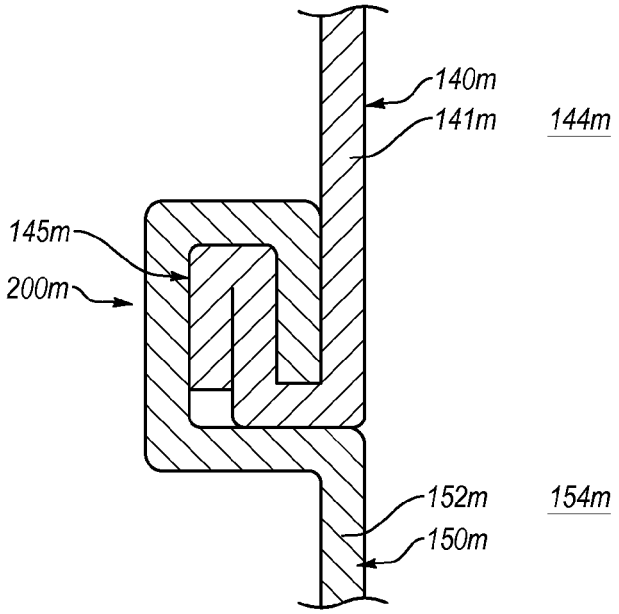
FIG. 11 is a partial cross-sectional view of two canister portions connected by a seam structure according to an embodiment.

It should be appreciated that the seam or seam structure may be positioned at any suitable location along the walls of any of the container portions. Moreover, the seam or seam structure may have any number of suitable configurations and/or bends, which may collectively produce a seal (e.g., crimped seal) between the corresponding portions, thereby sealing the internal space of the container. FIG. 11 is a partial, cross-sectional view of first and second container portions 140*m*, 150*m* connected together, according to an embodiment. More specifically, in the illustrated embodiment, the first container portion 140*m* and second container portion 150*m* are connected together by seam structure 200*m* formed therebetween. Except as otherwise described herein the first container portion 140*m* and/or second container portion 150*m* and their corresponding features, elements, components, or materials may be similar to or the same as any container portion described herein and their corresponding features, elements, components, and materials.

In an embodiment, a portion of a wall 141*m* of the first container portion 140*m* may be folded outward or away from an internal volume 144*m* of the first container portion 140*m*. Furthermore, the outward extending portion of the wall 141*m* may be folded onto itself to form a U-shaped section 145*m*. For example, the U-shaped section 145*m* may extend generally along the wall 141*m* of the first container portion 140*m* (e.g., the outward extending portion of the wall 141*m* may be bent to form the U-shaped section 145*m*, extending generally near and along the wall 141*m*). Moreover, the U-shaped section 145*m* may be spaced from the wall 141*m* in a manner that facilitates positioning a portion of a wall 152*m* of the second container portion 150*m* within the space between the U-shaped section 145*m* and the wall 141*m*.

In some embodiments, a portion or section of the wall 152*m* may extend outward and away from an interior space 154*m* of the second container portion 150*m*. Furthermore, the outward extending section of the wall 152*m* may wrap about the U-shaped section 145*m* of the wall 141*m*. For example, as mentioned above, after wrapping about the U-shaped section 145*m*, a portion of the outward extending section of the wall 152*m* may be positioned between the U-shaped section 145*m* and the outer surface of the wall 141*m*. Also, in an embodiment, the deformed section or portion of the wall 152*m* and the U-shaped section 145*m* may be compressed and/or deformed in a manner that connects and seals together the first container portion 140*m* and second container portion 150*m* (e.g., such as to prevent or impede air, gases, or other contaminants from entering the internal volumes 144*m*, 154*m* of the first and second container portions 140*m*, 150*m*, which collectively may define an internal volume of a container that secures a compact assembly therein).

As noted above, the compact assembly may include a preformed PCD table, which may be unattached to the substrate and positioned adjacent thereto. For example, the PCD table and/or PDC may be formed using any suitable HPHT process and may be subsequently placed into a container (e.g., according to one or more embodiments described herein) for further processing, such as for subjecting the container together with the compact assembly (e.g., a second substrate) to a second HPHT process, heating the container together with the compact assembly, or otherwise infiltrating the alloying material into the PCD table and bonding the PCD table to the second substrate. In any event, in some embodiments, the compact assembly may be a preformed PDC and the alloying material(s) may be positioned near and/or in contact with the PCD table, such that at least some of the alloying material(s) may infiltrate the PCD table, as described above.

For example, in the first HPHT process, the PCD table may be performed using an ultra-high pressure press to create temperature and pressure conditions at which diamond is stable to sinter diamond particles (i.e., diamond powder) in the presence of at least one Group VIII metal-solvent catalyst such as cobalt, iron, nickel, or alloys thereof. The temperature of the HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table. For example, the pressure of the first HPHT process may be about 7.5 GPa to about 10 GPa and the temperature of the HPHT process may be about 1150° C. to about 1450° C. (e.g., about 1200° C. to about 1400° C.). The foregoing pressure values employed in the HPHT process refer to the cell pressure in the pressure transmitting medium that transfers the pressure from the ultra-high pressure press to the assembly.

In any of the embodiments disclosed herein, the PCD table may be leached to at least partially remove or substantially completely remove at least one Group VIII metal-solvent catalyst (e.g., cobalt, iron, nickel, or alloys thereof) that was used to initially sinter precursor diamond particles to form the polycrystalline diamond. In another embodiment, an infiltrant used to re-infiltrate a preformed leached PCD table may be leached or otherwise have a metallic infiltrant removed to a selected depth from a upper surface. Moreover, in any of the embodiments disclosed herein, the PCD table may be un-leached and include at least one Group VIII metal-solvent catalyst (e.g., cobalt, iron, nickel, or alloys thereof) that was used to initially sinter the precursor diamond particles that form the PCD and/or an infiltrant used to re-infiltrate a preformed leached PCD table. Examples of methods for fabricating the PCD tables and PCD materials and/or structures from which the PCD tables and elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the PCD tables disclosed herein in an HPHT process may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 *μm,* 40 μm, 30 μm, 20 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 m, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting PCD formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the PCD elements may be free-standing (e.g., substrateless) and/or formed from a polycrystalline diamond body that is at least partially or fully leached to remove a metal-solvent catalyst initially used to sinter the polycrystalline diamond body.

As noted above, the PCD table may be bonded to the substrate. For example, the PCD table comprising PCD may be at least partially leached and bonded to the substrate with an infiltrant exhibiting a selected viscosity, as described in U.S. patent application Ser. No. 13/275,372, entitled "Polycrystalline Diamond Compacts, Related Products, And Methods Of Manufacture," the entire disclosure of which is incorporated herein by this reference. In an embodiment, an at least partially leached PCD table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a PCD table comprising bonded diamond grains defining interstitial regions having the catalyst disposed within at least a portion of the interstitial regions. The as-sintered PCD table may be leached by immersion in an acid or subjected to another suitable process to remove at least a portion of the catalyst from the interstitial regions of the polycrystalline diamond table, as described above. The at least partially leached PCD table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the PCD table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Figure 12A:
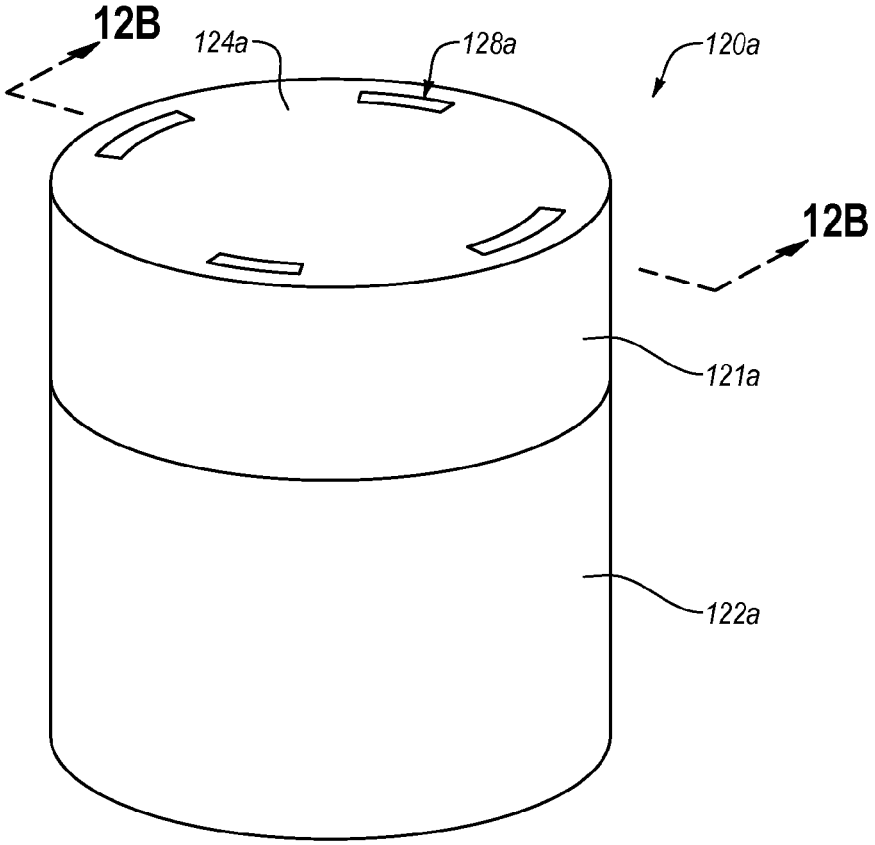
FIG. 12A is an isometric view of a compact assembly according to an embodiment.
Figure 12B:
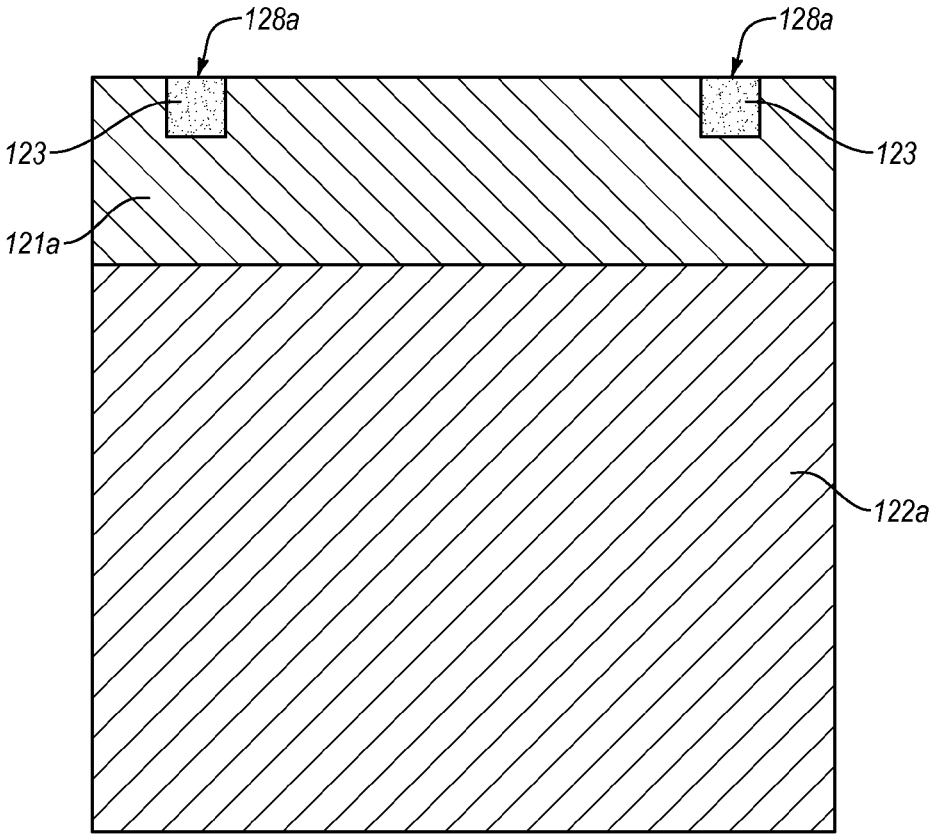
FIG. 12B is a cross-sectional view of the compact assembly of FIG. 12A.

Furthermore, in some embodiments, at least some of the alloying material(s) may be positioned in one or more recesses in a PCD table, when the compact assembly is placed in the container. FIGS. 12A-12B illustrate a compact assembly 120*a* according to an embodiment. For example, as shown in FIG. 12A, the compact assembly 120*a* and its features, materials, elements, or components may be similar to or the same as the compact assembly 120 (FIG. 1) and its respective features, materials, elements, and components. In an embodiment, the compact assembly 120*a* includes a PCD table 121*a*, substrate 122*a*, and an alloying material 123 (FIG. 12B), which may be similar to or the same as the respective the PCD table 121, substrate 122, and alloying material 123 (FIG. 1). Moreover, the PCD table 121*a* may define a upper surface 124*a* (e.g., a planar upper surface). In some embodiments, the PCD table 121*a* may have no chamfer (as shown in FIG. 12A); alternatively, as described above, the PCD table may include a chamfer at least partially surrounding the upper surface 124*a*.

Generally, a PCD table may include at least one recess. As shown in FIG. 12A, a PCD table 121*a* includes recesses 128*a* (not all labeled). Generally, the recesses 128*a* may be positioned and/or oriented relative to the PCD table 121*a* in any suitable manner, which may vary from one embodiment to another. For example, the recesses 128*a* may be circumferentially positioned relative to a center of the PCD table 121*a*. In other words, the recesses 128*a* may form an interrupted channel or groove in the PCD table 121*a*, which may extend approximately circumferentially. Alternatively, one or more recesses 128*a* may form or define one or more corresponding continuous channel or groove (e.g., that extend approximately circumferentially about a center of the PCD table 121*a*).

Figure 12C:
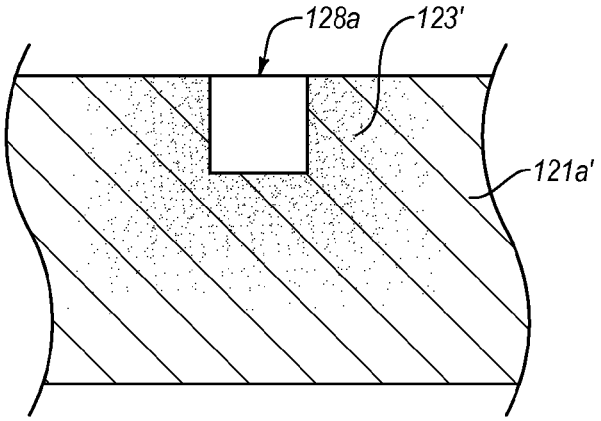
FIG. 12C is a partial cross-sectional view of a polycrystalline diamond table that has been infiltrated with an alloying material(s) according to an embodiment.

Generally, the recesses 128*a* may extend into the PCD table 121*a* to any suitable distance to accommodate the alloying material 123, as shown in FIG. 12B. The recesses 128*a* may extend into the PCD table 121*a* to any suitable distance (e.g., from 5% to 100% of the thickness of the PCD table 121*a*). In an embodiment, the alloying material 123 may be placed into the recesses 128*a* and the compact assembly 120*a* may be placed into any suitable container described above. Furthermore, the compact assembly 120*a* together with alloying material 123 may be placed into the container and subjected to HPHT process. For example, the alloying material 123 may infiltrate the PCD table 121*a* from the recess 128*a*, thereby forming the PCD table 121*a*', as shown in FIG. 12C. In an embodiment, the highest concentration of the alloying material 123 in the PCD table 121*a*' is closer to the recesses 172*a* and lowest concentration of the alloying material 123 is closest to the interface between the PCD table 121*a*' and the substrate.

It should be appreciated that the compact assembly may include diamond powder positioned adjacent to and/or in contact with a substrate. For example, the substrate and the diamond powder may be positioned in the canister and the alloying material(s) (e.g., white phosphorus, red phosphorous, violet phosphorous, black phosphorous, combinations thereof, etc.) may be positioned adjacent to and/or in contact with the diamond powder inside the canister. In other words, in an embodiment, the substrate, diamond powder, and alloying material(s) may be sealed together in the canister and subjected to HPHT process as described herein.

Moreover, as mentioned above, the compact assembly including the PCD table may be subjected to a heating and/or to a second HPHT process to alloy the PCD table (e.g., to diffuse and/or infiltrate at least some of the alloying material into the at least one Group VIII metal disposed in at least a portion of the interstitial regions of the PCD table. The temperature of the second HPHT process is chosen to promote diffusion and/or alloying of the alloying material(s), such as phosphorous, into the PCD table to alloy the at least one Group VIII metal therein to a selected depth measured from an upper/outer surface thereof, such as at least 250 μm, at least about 250 μm, about 400 μm to about 700 μm, or about 600 μm to about 800 μm. For example, the pressure of the second HPHT process may be about 5.2 GPa to about 6.5 GPa and the temperature of the second HPHT process may be about 1380° C. to about 1900° C., and the temperature of the first HPHT process may be about 1350° C. to about 1450° C. For example, in an embodiment, the pressure of the second HPHT process may be about 5.2 GPa to about 6.5 GPa (e.g., 5 GPa to about 5.5 GPa) and the temperature of the second HPHT process may be about 1000° C. to about 1500° C. (e.g., 1380° C. to about 1500, or about 1400° C.), and the pressure of the first HPHT process may be about 7.5 GPa to about 8.5 GPa and the temperature of the first HPHT process may be about 1370° C. to about 1430° C. (e.g., about 1400° C.). For example, the pressure of the second HPHT process may be lower than that of the first HPHT process, which may help prevent damage to the PCD table during the second HPHT process. In other embodiments, the compact assembly including the PCD table may be subjected to a heating process that is at a relatively low pressure compared to an HPHT process (e.g., ambient pressure or less than 1 GPa) and employing any of the temperature ranges discussed above for the second HPHT process including lower temperature ranges such as about 500° C. to about 800° C. or about 750° C. or less.

Figure 13A:
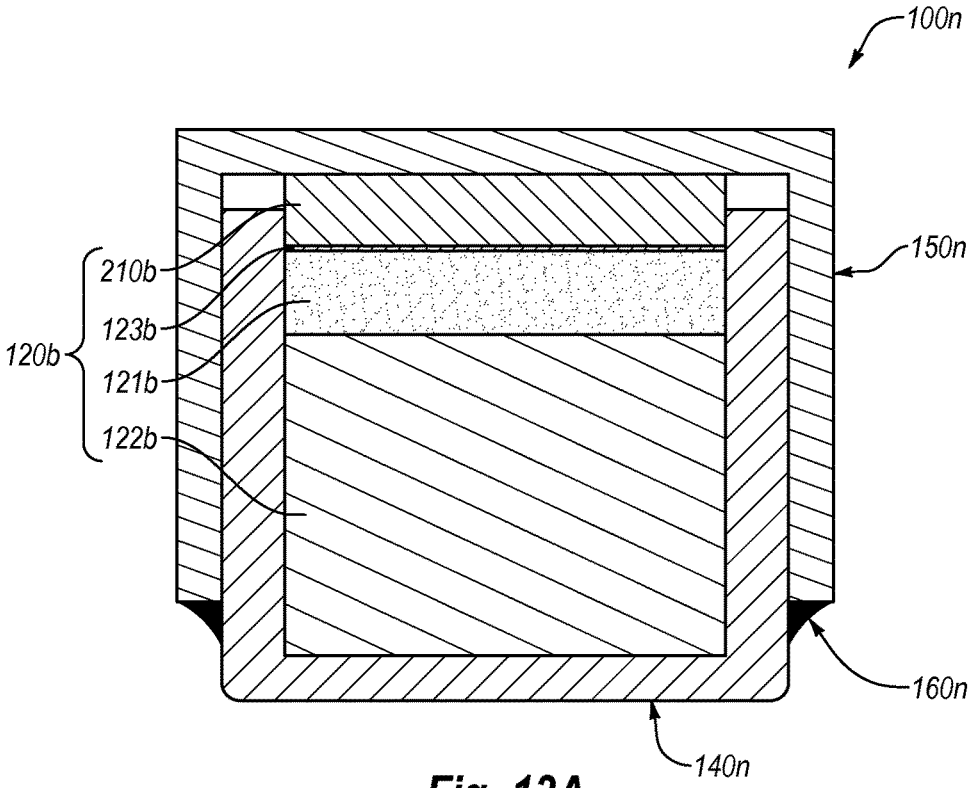
FIG. 13A is a cross-sectional view of a compact assembly positioned in a canister according to an embodiment.

Additionally or alternatively, the alloying material may be positioned and/or coated on a pre-shaped shaping medium (e.g., a slug or mold) of a suitable material (e.g., material that may be relatively stable at the elevated temperatures and pressure of the HPHT process, material that may be relatively non-reactive with the alloying material, combinations of the foregoing, etc.). FIG. 13A illustrates a compact assembly 120*b* sealed in a canister 100*n*, according to one or more embodiments. Except as otherwise described herein, the compact assembly 120*b* and the canister 100*n* and their respective features, materials, elements, or components may be similar to or the same as any of the respective compact assemblies 120, 120*a* and canisters 100-100*m* (FIGS. 1-12C) and their corresponding features, materials, elements, and components. In an embodiment, the compact assembly 120*b* may include diamond powder 121*b* positioned adjacent to and/or at least partially in contact with a substrate 122*b*. The compact assembly 120*b* also may include a pre-shaped shaping medium 210*b* and an alloying material 123*b* that may be positioned adjacent to and/or at least partially in contact with the diamond powder 121*b*.

In an embodiment, the alloying material 123*b* may be attached to and/or coated on the pre-shaped shaping medium 210*b*. For example, the pre-shaped shaping medium 210*b* may include or be formed from hexagonal boron nitride ("HBN") and may be substantially unitary, and the alloying material 123*b* may include or be formed from boron. For example, the HBN may be sintered HBN or cold-pressed HBN powder. It should be appreciated, however, that the alloying material 123*b* may be formed from and/or may include any of the alloying materials described herein or combinations thereof. In some embodiments, the alloying material 123*b* may be sprayed, painted, dipped, or otherwise coated onto the pre-shaped shaping medium 210*b*. For example, the alloying material 123*b* may be attached or placed on the pre-shaped shaping medium 210*b* in a manner that prevents or limits mixing of the alloying material 123*b* with the diamond powder 121*b* prior to HPHT processing. For example, a suitable binder may be applied to the pre-shaped shaping medium 210*b* followed by applying the alloying material 123*b* in powder form, which bonds to the pre-shaped shaping medium 210*b* via the binder. This application/binding process may be repeated multiple times until a desired number of layers or regions of the powdered alloying material is formed on the pre-shaped shaping medium 210*b*. Optionally, the pre-shaped shaping medium 210*b* may be heated to vaporize and remove the binder from the pre-shaped shaping medium 210*b* prior to incorporating the pre-shaped shaping medium 210*b* into the compact assembly 120*b*.

Generally, the compact assembly 120*b* may be sealed in any of the canisters described herein. As mentioned above, in the illustrated embodiment, the compact assembly 120*b* is sealed in the canister 100*n*. More specifically, according to an embodiment, the canister 100*n* includes first and second container portions 140*n*, 150*n* connected and sealed together by a weld 160*n* therebetween. Furthermore, the first and second container portions 140*n*, 150*n* define an internal container volume, within which the compact assembly 120*b* is positioned and sealed, as described above.

In any event, the canister 100*n* together with the compact assembly 120*b* may be subjected to HPHT process. In particular, for example, during the HPHT process, the diamond particles 123*b* may be sintered together (e.g., a catalyst material from the substrate 122*b* may facilitate diamond growth during the HPHT process) to form bonded-together diamond grains with interstitial regions therebetween. In some embodiments, the alloying material may infiltrate and/or diffuse into the interstitial regions (e.g., during the HPHT process) and alloy with the catalyst material during and/or after a PCD table is formed from the diamond particles being sintered.

For example, in an embodiment, the substrate 122*b* may comprise a cobalt-cemented tungsten carbide substrate and the alloying material may comprise phosphorous and/or boron. During HPHT processing, cobalt from the cobalt-cemented tungsten carbide substrate sweeps into the diamond powder to catalyze diamond-to-diamond bonding and formation of bonded-together diamond grains, while the alloying material infiltrates and/or diffuses into the cobalt in the interstitial regions between the bonded-together diamond grains to alloy with the cobalt. For example, when the alloying material includes phosphorous, as previously discussed, the alloy so formed may include a WC phase, a $Co_2P$ cobalt-phosphorous intermetallic compound phase, a Co phase (e.g., substantially pure cobalt or a cobalt solid solution phase), and optionally elemental phosphorous in various amounts or no elemental phosphorous. In such an embodiment, the phosphorous may be present with the cobalt in an amount of about 30 atomic % to about 34 atomic % of the alloy and, more specifically, about 33.33 atomic % of the alloy. According to one or more embodiments, the WC phase may be present in the alloy in an amount less than 1 weight %, or less than 3 weight %; the $Co_2P$ cobalt-phosphorous intermetallic compound phase may be present in the alloy in an amount greater than 80 weight %, about 80 weight % to about 95 weight %, more than 90 weight %, about 85 weight % to about 95 weight %, or about 95 weight % to about 99 weight %; and the Co phase (e.g., substantially pure cobalt or a cobalt solid solution phase) may be present in the alloy in an amount less than 1 weight %, or less than 3 weight %. Any combination of the recited concentrations (or other concentrations disclosed herein) for the foregoing phases may be present in the alloy.

For example, when the alloying material(s) includes boron, as previously discussed, the alloy so formed may include WC phase, $Co_AW_BB_C$ (e.g., $Co_{21}W_2B_6$) phase, $Co_DB_E$ (e.g., $Co_2B$ or $BCo_2$) phase, and Co phase (e.g., substantially pure cobalt or a cobalt solid solution phase) in various amounts. According to one or more embodiments, the WC phase may be present in the alloy in an amount less than 1 weight %, or less than 3 weight %; the $Co_AW_BB_C$ (e.g., $Co_{21}W_2B_6$) phase may be present in the alloy in an amount less than 1 weight %, about 2 weight % to about 5 weight %, more than 10 weight %, about 5 weight % to about 10 weight %, or more than 15 weight %, the $Co_DB_E$ (e.g., $Co_2B$ or $BCo_2$) phase may be present in the alloy in an amount greater than about 1 weight %, greater than about 2 weight %, or about 2 weight % to about 5 weight %; and the Co phase (e.g., substantially pure cobalt or a cobalt solid solution phase) may be present in the alloy in an amount less than 1 weight %, or less than 3 weight %. Any combination of the recited concentrations (or other concentrations disclosed herein) for the foregoing phases may be present in the alloy.

Also, when sintered, the diamond particles 123*b* may form or define a PCD table. In some embodiments, the PCD table may have a generally flat or planar upper surface. Alternatively, at least a portion of the upper surface may be surrounded by a chamfer. In at least one embodiment, the pre-shaped shaping medium may be shaped and configured to form one or more desired or suitable shapes (e.g., a chamfer) on or in the PCD table.

Figure 13B:
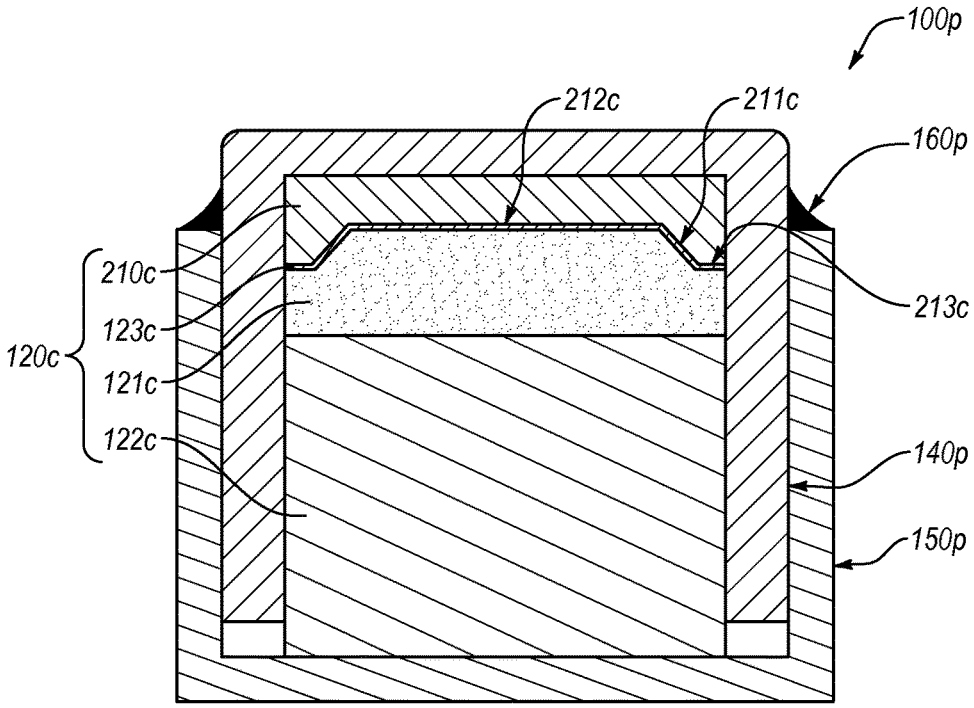
FIG. 13B is a cross-sectional view of a compact assembly positioned in a canister according to another embodiment.

FIG. 13B illustrates a canister 100*p* and a compact assembly 120*c* that includes a shaped pre-shaped shaping medium 210*c*, according to an embodiment. Except as otherwise described herein, the compact assembly 120*c* and the canister 100*p* and their respective features, materials, elements, or components may be similar to or the same as any of the respective compact assemblies 120, 120*a*, 120*b* and canisters 100-100*n* (FIGS. 1-13A) and their corresponding features, materials, elements, and components. Generally, as mentioned above, the compact assembly 120*c* may be positioned in any suitable canister (e.g., as described herein). In the illustrated embodiment, first and second container portions 140*p*, 150*p* of the canister 100*p* define an internal volume within which the compact assembly 120*c* is positioned (e.g., the first and second container portions 140*p*, 150*p* may be secured and/or sealed together by a weld 160*p*).

Similar to the compact assembly 120*b* (FIG. 13A), the compact assembly 120*c* may include multiple diamond particles 121*c* positioned adjacent to and/or in contact with a substrate 122*c*. Moreover, the compact assembly 120*c* may include the pre-shaped shaping medium 210*c* and alloying material 123*c* positioned and/or coated on the pre-shaped shaping medium 210*c*.

In some embodiments, the pre-shaped shaping medium 210*c* may define a chamfer in the diamond particles 123*c* and in the PCD table so formed from sintering the diamond particles 123*c* together. In particular, for example, the pre-shaped shaping medium 210*c* may include a chamfer 211*c* (e.g., extending outward from a planar surface 212*c*, which may form or define the upper surface of the PCD table formed by the sintered diamond particles 123*c*). For example, the pre-shaped shaping medium 210*c* may be formed from sintered HBN or cold-pressed HBN powder. In an embodiment, the pre-shaped shaping medium 210*c* may include a landing 213*c*, which may form or define a generally planar or flat surface extending laterally outward from the chamfer 211 *c* (e.g., the chamfer 211*c* may extend between the landing 213*c* and the planar surface 212*c*).

As such, the pre-shaped shaping medium 210*c* may form the shape of the PCD table that may be generally complementary to the shape of the pre-shaped shaping medium 210*c*. In at least one embodiment, the PCD table may be formed with a chamfer extending from the upper surface to a ledge, which may extend outward from the chamfer (e.g., the chamfer 211*c* may form the corresponding chamfer of the PCD table, the planar surface 212*c* may form the upper surface of the PCD table, and the landing 213*c* may form the ledge of the PCD table. In an embodiment, after processing, the PCD table and/or PDC may be machined to remove the ledge (e.g., the PDC may be ground with a centerless grinder, cylindrical grinder, etc.).

As described above, the alloying material 123*c* may be secured and/or coated on the pre-shaped shaping medium 210*c* and may infiltrate and/or diffuse into interstitial regions between the diamond grains formed from sintered diamond particles 123*c*. In an embodiment, the alloying material 123*c* may generally follow the shape of the pre-shaped shaping medium 210*c*. For example, the alloying material 123*c* may infiltrate and/or diffuse into the interstitial regions between the diamond grains to a selected distance from the respective upper surface and surface of the chamfer (e.g., the selected distance from the upper surface and the infiltration distance from the surface of the chamfer may be approximately the same).

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of manufacturing a polycrystalline diamond compact, the method comprising:

forming a canister assembly including:

a first canister portion and a second canister portion, the first canister portion and the second canister portion collectively defining an internal volume of the canister assembly; and a compact assembly positioned in the internal volume of the canister assembly, the compact assembly including:

a polycrystalline diamond element;

a substrate bonded to an interfacial surface of the polycrystalline diamond element; and phosphorous positioned adjacent to an upper surface of the polycrystalline diamond element;

sealing the internal volume of the canister assembly to form a sealed internal volume including the compact assembly; and after sealing the internal volume of the canister assembly, subjecting the canister assembly to one or more of a high-pressure/high-temperature process or a heating process effective to alloy the polycrystalline diamond element with the phosphorous.

2. The method of claim 1 wherein sealing the internal volume of the canister assembly to form a sealed internal volume including the compact assembly includes producing a substantially inert environment in the internal volume.

3. The method of claim 2 wherein producing a substantially inert environment in the processing volume includes one or more of evacuating gases from the internal volume of the canister assembly or supplying one or more inert gases into the internal volume of the canister assembly.

4. The method of claim 2 wherein producing a substantially inert environment in the processing volume includes replacing at least some oxygen gas in the processing volume with an inert gas.

5. The method of claim 1 wherein subjecting the canister assembly to one or more of a high-pressure/high-temperature process or a heating process elevates the temperature of the phosphorous to a temperature of about 1350° C. to about 1450° C.

6. The method of claim 1 wherein sealing the internal volume of the canister assembly includes sealing the first and second canister portions together.

7. The method of claim 6 wherein sealing the first and second canister portions together includes one or more of welding, brazing, or forming a seam structure between the first and second canister portions in a manner that does not raise temperature of the phosphorous above a selected temperature.

8. The method of claim 1 wherein the canister assembly includes a third canister portion and one or more of the first and second canister portions is positioned at least partially inside an internal volume of the third canister portion.

9. The method of claim 8 wherein:

the second canister portion is fitted over the first canister portion; and sealing the internal volume of the canister assembly includes sealing the second canister portion and the third canister portion together.

10. The method of claim 8 wherein the canister assembly further includes a fourth canister portion.

11. The method of claim 10 wherein one or more of the first, second, or third canister portions is positioned at least partially inside an internal volume of the fourth canister portion.

12. The method of claim 11 wherein:

the third canister portion includes a flange; and sealing the third canister portion and the fourth canister portion together includes forming a seam structure therebetween including bending one or more portions of the fourth canister portion about the flange of the third canister portion.

13. The method of claim 12 further comprising positioning a sealing washer on the flange of the third canister portion in a manner that bending at least one or more portions of the fourth canister portion about the flange of the third canister portion positions the sealing washer between the flange of the third canister portion and the one or more bent portions of the fourth canister portion.

14. The method of claim 1 wherein:

the polycrystalline diamond element defines a polycrystalline diamond table that includes a plurality of bonded diamond grains defining a plurality of interstitial regions at least a portion of which includes at least one Group VIII metal disposed therein; and subjecting the assembly to one or more of a high-pressure/high-temperature process or a heating process infiltrates or diffuses at least some of the phosphorous into the at least one Group VIII metal.

15. The method of claim 14 wherein the polycrystalline diamond table includes one or more recesses and the phosphorous is positioned in at least one of the one or more recesses.

16. The method of claim 14 wherein the phosphorous is positioned adjacent to at least a portion of an upper surface of the polycrystalline diamond table and a chamfer surface of the polycrystalline diamond table.

17. The method of claim 16, wherein phosphorous is positioned adjacent to at least a portion of a peripheral surface of the polycrystalline diamond table.

18. The method of claim 1 wherein the phosphorous includes one or more of white phosphorus, red phosphorous, violet phosphorous, or black phosphorous.

19. A method of manufacturing a polycrystalline diamond compact, the method comprising:

forming a canister assembly including:

a first canister portion and a second canister portion, the first canister portion and the second canister portion collectively defining an internal volume of the canister assembly; and a compact assembly positioned in the internal volume of the canister assembly, the compact assembly including:

a substrate;

a polycrystalline diamond table having an interfacial surface that is bonded to the substrate, the polycrystalline diamond table including a plurality of diamond grains defining a plurality of interstitial regions therebetween, at least a portion of the plurality of interstitial regions including at least one Group VIII metal disposed therein; and phosphorous positioned adjacent to an upper surface of the polycrystalline diamond table;

sealing the internal volume of the canister assembly to form a sealed internal volume including the compact assembly including evacuating gases from the internal volume of the canister assembly; and after sealing the canister assembly, subjecting the canister assembly to a heating process effective to alloy the at least one Group VIII metal of the polycrystalline diamond element with the phosphorous.

20. The method of claim 19 wherein evacuating gases from the internal volume of the canister includes exposing the canister assembly to a partial vacuum of about $10^{-2}$ torr or less.

21. A method of manufacturing a polycrystalline diamond compact, the method comprising:

forming a canister assembly including:

a first canister portion and a second canister portion, the first canister portion and the second canister portion collectively defining an internal volume of the canister assembly; and a compact assembly positioned in the internal volume of the canister assembly, the compact assembly including:

a polycrystalline diamond table that includes a plurality of bonded diamond grains defining a plurality of interstitial regions at least a portion of which includes at least one Group VIII metal disposed therein; and phosphorous positioned adjacent to at least a portion of an upper surface and a chamfer surface of the polycrystalline diamond table;

sealing the internal volume of the canister assembly to form a sealed internal volume including the compact assembly; and after sealing the internal volume of the canister assembly, subjecting the canister assembly to one or more of a high-pressure/high-temperature process or a heating process effective to infiltrate or diffuse at least some of the phosphorous into the at least one Group VIII metal to alloy the at least one Group VIII metal with the phosphorous.

22. The method of claim 21 wherein the phosphorous includes one or more of white phosphorus, red phosphorous, violet phosphorous, or black phosphorous.

23. The method of claim 21 wherein phosphorous is positioned adjacent to at least a portion of a peripheral surface of the polycrystalline diamond table.

* * * * *